US009892705B2

(12) United States Patent
Park et al.

(10) Patent No.: US 9,892,705 B2
(45) Date of Patent: Feb. 13, 2018

(54) DATA DRIVER AND METHOD OF DRIVING THE SAME

(71) Applicant: SAMSUNG DISPLAY CO., LTD., Yongin, Gyeonggi-Do (KR)

(72) Inventors: Suhyeong Park, Gyeongju-si (KR); Hoyong Jung, Seongnam-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 119 days.

(21) Appl. No.: 14/687,136

(22) Filed: Apr. 15, 2015

(65) Prior Publication Data

US 2016/0049133 A1 Feb. 18, 2016

(30) Foreign Application Priority Data

Aug. 13, 2014 (KR) ..... 10-2014-0105357

(51) Int. Cl.
*G09G 3/36* (2006.01)

(52) U.S. Cl.
CPC ..... *G09G 3/3688* (2013.01); *G09G 3/3648* (2013.01); *G09G 3/3696* (2013.01); *G09G 2310/027* (2013.01); *G09G 2310/0243* (2013.01); *G09G 2310/0291* (2013.01); *G09G 2310/0297* (2013.01); *G09G 2340/16* (2013.01)

(58) Field of Classification Search
CPC .. G09G 3/36; G09G 5/00; G09G 5/10; G09G 3/34; G11C 19/00; G06F 3/038
See application file for complete search history.

(56) References Cited

U.S. PATENT DOCUMENTS

2004/0036670 A1* 2/2004 Chung ..... G09G 3/3688 345/99
2007/0024542 A1* 2/2007 Chung ..... G09G 3/2011 345/76
2009/0273593 A1* 11/2009 Tonogai ..... G09G 3/3688 345/214

(Continued)

FOREIGN PATENT DOCUMENTS

KR 10-0880223 B1 1/2009
KR 10-2010-0077325 A 7/2010
KR 10-2012-0120517 A 11/2012

(Continued)

OTHER PUBLICATIONS

Dongmyung Lee, A 1.4-Gbps Intra-panel interface with low-power and low EMI schemes for Tablet PC applications, Journal of the SID 20/12, 2012, pp. 661-668.

*Primary Examiner* — Pegeman Karimi
(74) *Attorney, Agent, or Firm* — Lee & Morse, P.C.

(57) ABSTRACT

A data driver includes buffers, bias circuits, and a bias signal generator. The buffers respectively output data voltages corresponding to pixel image data. The bias circuits generate bias currents independent of each other and apply the bias currents to respective ones of the buffers. The bias signal generator generates a plurality of bias signals. Each of the bias circuits include a selector and a bias current generator. The selector selects one bias signal among the bias signals based on corresponding pixel image data and outputs the selected bias signal as a final bias signal. The bias current generator generates a corresponding bias current among the bias currents based on the final bias signal.

18 Claims, 15 Drawing Sheets

(56) References Cited

U.S. PATENT DOCUMENTS

| | | | | |
|---|---|---|---|---|
| 2012/0013587 | A1 | 1/2012 | Yen | |
| 2014/0125713 | A1* | 5/2014 | Ryu | G09G 3/3291 345/690 |

FOREIGN PATENT DOCUMENTS

| | | | |
|---|---|---|---|
| KR | 10-2013-0128933 | A | 11/2013 |
| KR | 10-2015-0055253 | A | 5/2015 |
| KR | 10-2016-0032772 | A | 3/2016 |

* cited by examiner

DATA DRIVER AND METHOD OF DRIVING THE SAME

CROSS-REFERENCE TO RELATED APPLICATION

Korean Patent Application No. 10-2014-0105357, filed on Aug. 13, 2014, and entitled, "Data Driver and Method of Driving the Same," is incorporated by reference herein in its entirety.

BACKGROUND

1. Field

One or more embodiments described herein relate to a data driver and a method for driving a data driver.

2. Description of the Related Art

A display apparatus generally includes switching devices connected to pixel electrodes, gate lines, and data lines. An AC/DC converter may also be included to generate various types of voltages. For example, the AC/DC converter may convert an alternating current power source to a direct current power source. An analog circuit may also be included to convert direct current power to an analog driving voltage.

The analog driving voltage may be generated, for example, by controlling the level of a reference power source using a power source regulator. The voltage output from the reference power source voltage may be increased using a booster circuit, e.g., an electric charge pump. A data driver generates data voltages based on the analog driving voltage and outputs the data voltages to respective data lines of the display apparatus, for example, through buffers. In operation, power consumption may increase when the data driver outputs the data voltages.

SUMMARY

In accordance with one embodiment, a data driver includes a plurality of buffers to respectively output data voltages corresponding to pixel image data; a plurality of bias circuits provided in one-to-one correspondence with the buffers, the bias circuits to generate bias currents independent of each other and to apply the bias currents to the buffers, respectively; and a bias signal generator to generate a plurality of bias signals, wherein each of the bias circuits include: a selector to select one bias signal among the bias signals based on corresponding pixel image data among the pixel image data and to output the selected bias signal as a final bias signal; and a bias current generator to generate a corresponding bias current among the bias currents based on the final bias signal.

The data driver may include a sampling latch to receive input image data and to sample the pixel image data from the input image data based on a sampling signal; and a digital-to-analog converter to convert the pixel image data to the data voltages and to apply the data voltages to the buffers in one-to-one correspondence, wherein the selector is to receive the corresponding pixel image data from the sampling latch among the pixel image data.

The selector may include a variation detector, and a signal multiplexer, wherein the variation detector is to receive the corresponding pixel image data among the pixel image data and to generate a selection signal based on the corresponding pixel image data, and wherein the signal multiplexer is to select one of the bias signals based on the selection signal.

The corresponding pixel image data among the pixel image data may include a previous pixel image data provided in an (L−1)th horizontal period and a present pixel image data provided in an L-th horizontal period, and the variation detector may include a pixel memory to store the previous pixel image data; and a comparator to calculate an absolute value of a difference between a previous grayscale value of the previous pixel image data and a present grayscale value of the present pixel image data, and to generate the selection signal based on the calculated absolute value.

The comparator may compare upper i ("i" is a natural number) bits of the previous pixel image data and upper i bits of the present pixel image data to generate the selection signal, and wherein a number of the bias signals is 2×i. The value of i may be 1 and the comparator may receive the previous pixel image data and the present pixel image data and may perform an exclusive-OR calculation on the previous pixel image data and the present pixel image data.

The bias signals may include a first bias signal, and a second bias signal different from the first bias signal, the first bias signal may include a first transition period and a first control period which are defined in each horizontal period, wherein the second bias signal may include a second transition period and a second control period which are defined in each horizontal period, wherein the first bias signal may have a first transition level in the first transition period and has a first control level lower than the first transition level in the first control period, and wherein the second bias signal may have a second transition level in the second transition period and has a second control level lower than the second transition level in the second control period.

The first control level may be different from the second control level. The first transition level may be different from the second transition level. At least a portion of the first control period may not overlap the second control period.

The bias signal generator may include a bias signal generator including first and second sub-bias signal generators to respectively generate the first and second bias signals, wherein: the first sub-bias signal generator may generate the first bias signal based on a first transition level value determining the first transition level, a first control level value determining the first control level, and a first activation signal determining the first control period, and the second sub-bias signal generator may generate the second bias signal based on a second transition level value determining the second transition level, a second control level value determining the second control level, and a second activation signal determining the second control period.

The first sub-bias signal generator may include: first level value multiplexer to select one value of the first transition level value or the first control level value based on the first activation signal, and to output the selected value as a first intermediate bias signal; and a first bias signal generating circuit to generate the first bias signal based on the first intermediate bias signal and a reference bias current, and the second sub-bias signal generator may include: a second level value multiplexer to select one value of the second transition level value or the second control level value based on the second activation signal, and to output the selected value as a second intermediate bias signal; and a second bias signal generating circuit to generate the second bias signal based on the second intermediate bias signal and the reference bias current.

The bias signal generator may subtract the first bias different value from the first transition level value to generate the first control level value, and may subtract the second bias different value from the first transition level value to generate the second control level value, the first bias difference value may include information indicative of a difference between the first transition level and the first control level, and the second bias difference value may include information indicative of a difference between the second transition level and the second control level.

The bias signal generator may include a counter to generate the first control activation signal based on a first control start time point corresponding to a start point of the first control period and a first control end time point corresponding to an end point of the first control period, and to generate the second control activation signal based on a second control start time point corresponding to a start point of the second control period and a second control end time point corresponding to an end point of the second control period.

The bias signal generator may include: an image controller to receive the input image data, analyze the input image data, and generate at least one of the transition level value, the first and second bias difference values, the first and second control start time points, and the first and second control end time points based on the analyzed result. The image controller may analyze the input image data every horizontal period.

In accordance with another embodiment, a method for driving a data driver comprising generating a plurality of data voltages based on pixel image data; outputting the data voltages through a plurality of buffers, respectively; generating bias currents; applying the bias currents to the buffers, respectively; and generating a plurality of bias signals, wherein applying the bias currents to the buffers includes selecting one of the bias signals with respect to each of the buffers based on the pixel image data and generating the bias currents in accordance with the selected bias signal.

Each of the pixel image data may include a previous pixel image data provided in an (L−1)th horizontal period and a present pixel image data provided in an L-th horizontal period, and selecting one of the bias signals may include: calculating an absolute value of a difference between a previous grayscale value of the previous pixel image data and a present grayscale value of the present pixel image data; and selecting one of the bias signals in accordance with the calculated absolute value.

Calculating the absolute value of the difference between the previous grayscale value of the previous pixel image data and the present grayscale value of the present pixel image data may include comparing upper i (i is a natural number) bits of the previous pixel image data and upper i bits of the present pixel image data. Comparing the upper bits may include: receiving the previous pixel image data and the present pixel image data; and performing an exclusive-OR calculation on previous pixel image data and the present pixel image data.

In accordance with another embodiment, a data driver includes a plurality of buffers to respectively output data voltages; and a plurality of bias circuits to respectively output bias currents based on variation in an amount of a corresponding data voltage among the data voltages in each horizontal period, wherein the bias circuits are provided in one-to-one correspondence to the buffers and are to apply the bias currents to the buffers, respectively.

The data driver may include a bias signal generator to generate a plurality of bias signals, wherein each of the bias circuits include: a selector to select one of the bias signals and to outputs the selected bias signal as a final bias signal; and a bias current generator to generate the bias current based on the bias signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
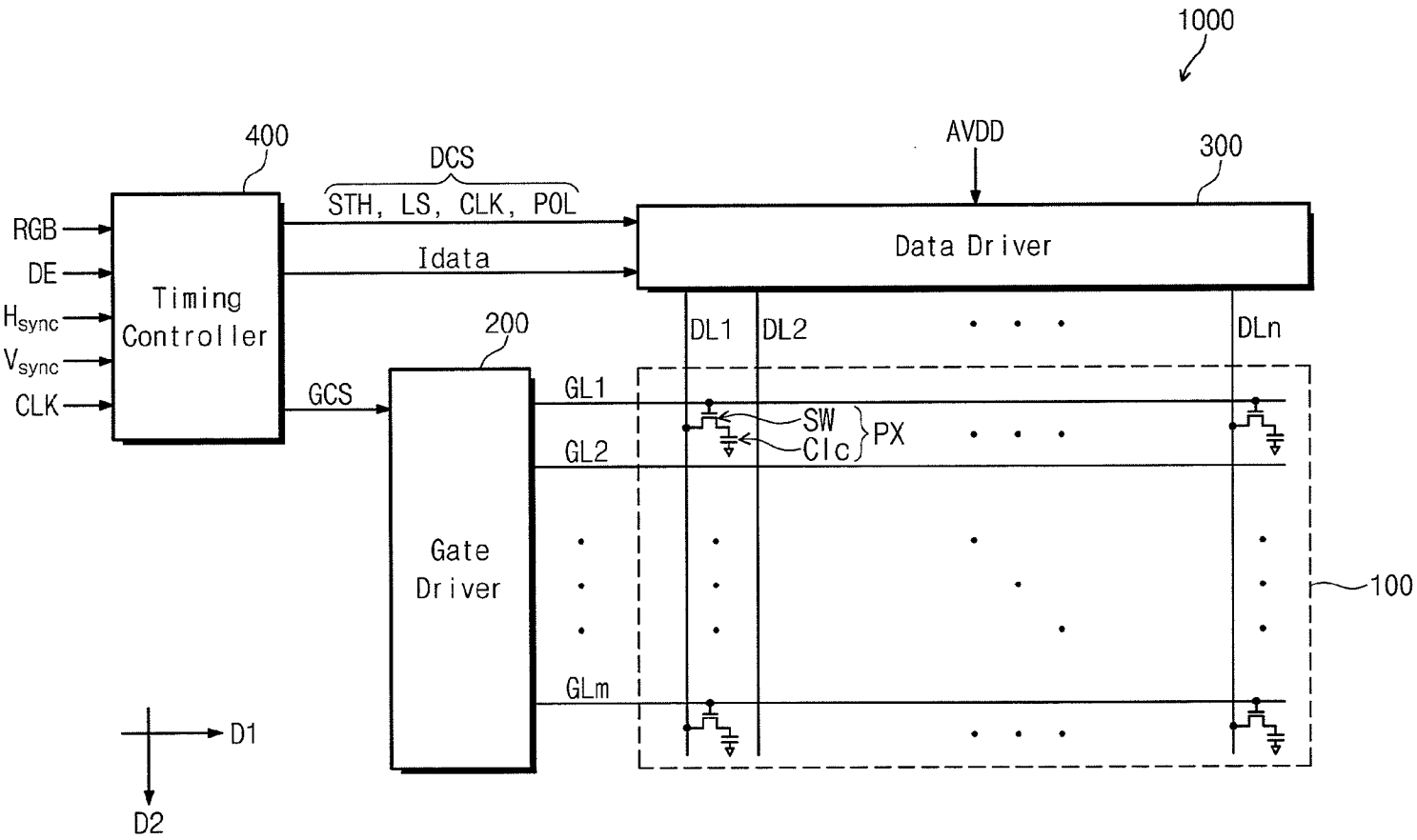
FIG. 1 illustrates an embodiment of a display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

FIG. 1 illustrates an embodiment of a display apparatus 1000 which includes a display panel 100 to display an image, gate and data drivers 200 and 300 to drive the display panel 100, and a timing controller 400 to control a drive of the gate and data drivers 200 and 300. The display panel may be a liquid crystal display panel, an organic light emitting display panel, an electrophoretic display panel, an electrowetting display panel, or another type of display device.

The timing controller 400 receives image information (e.g., RGB) and control signals, for example, from an external image source. The control signals include, for example, a vertical synchronization signal Vsync as a frame distinction signal, a horizontal synchronization signal Hsync as a row distinction signal, a data enable signal DE that defines a period in which data are input, and a clock signal CLK. The data enable signal DE may maintain a predetermined (e.g., high) level only during a period in which the data area output.

The timing controller 400 converts a data format of the image information RGB, to a data format appropriate to an interface between the data driver 300 and the timing controller 400, to generate an input image data Idata. The input image data Idata is applied to the data driver 300. In addition, the timing controller 400 generates a data control signal DCS and a gate control signal GCS based on the control signals. The timing controller 400 applies the data control signal DCS to the data driver 300 and applies the gate control signal GCS to the gate driver 200.

The gate control signal GCS includes a scanning start signal to indicate the start of the scanning, the clock signal CLK to control an output period of a gate-on voltage, and an output enable signal to control a maintaining time of the gate-on voltage.

The data control signal DCS includes a horizontal start signal STH to indicate a start of transmission of the input image data Idata to the data driver 300, a load signal MS, an inverting signal POL, and the clock signal CLK.

The gate driver 200 sequentially applies gate signals to the display panel 100 based on the gate control signal GCS from the timing controller 400.

The data driver 300 converts the input image data Idata to the data voltages based on the data control signal DCS from the timing controller 400. The data voltages are applied to the display panel 100.

The display panel 100 includes a plurality of gate lines GL1 to GLm, a plurality of data lines DL1 to DLn, and a plurality of pixels PX. The gate lines GL1 to GLm extend in a first direction D1 and are arranged substantially in parallel to each other in a second direction D2 substantially perpendicular to the first direction D1. The gate lines GL1 to GLm are connected to the gate driver 200 to receive the gate signals from the gate driver 200. The data lines DL1 to DLn extend in the second direction D2 and are arranged substantially in parallel to each other in the first direction D1. The data lines DL1 to DLn are connected to the data driver 300 to receive the data voltages from the data driver 300.

In the case where display panel 100 is a liquid crystal display, each pixel PX may include, for example, a switching device SW to output a data signal based on the gate signal and a liquid crystal capacitor Clc charged with the data voltage. Each pixel PX is connected to a corresponding gate line of the gate lines GL1 to GLm and a corresponding data line of the data lines DL1 to DLn. For example, each pixel PX is turned on or off based on the gate signal applied through a corresponding gate line. The turned-on pixel PX emits light having a grayscale value corresponding to a data voltage applied through a corresponding data line.

Figure 2:
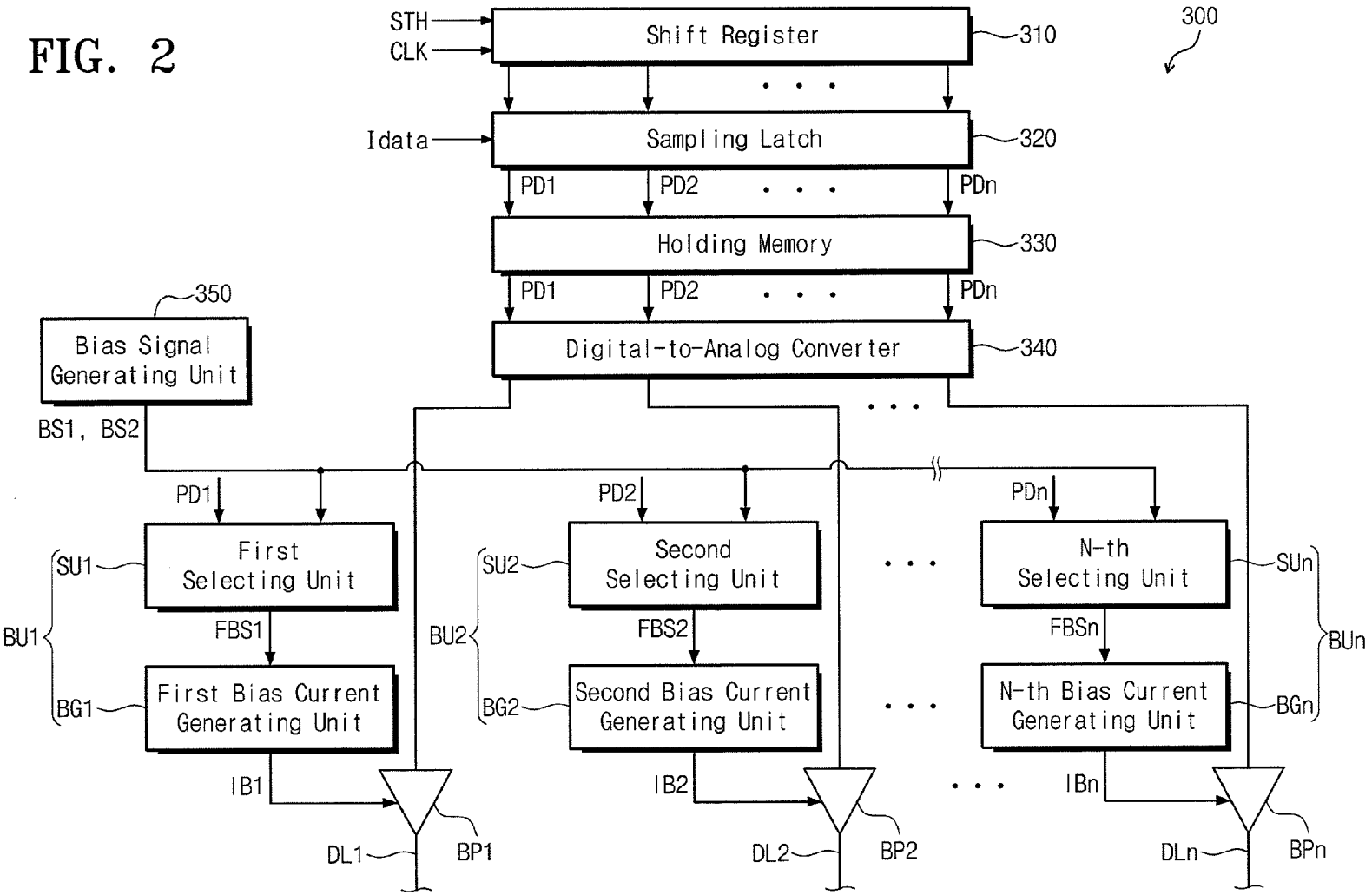
FIG. 2 illustrates an embodiment of a data driver.

FIG. 2 illustrates an embodiment of data driver 300 in FIG. 1. Referring to FIG. 2, the data driver 300 includes a shift register 310, a sampling latch 320, a holding memory 330, a digital-to-analog converter 340, and first to n-th buffers BP1 to BPn.

The shift register 310 includes a plurality of stages connected to each other, one after another. Each stage receives the clock signal CLK and a first stage is applied with the horizontal start signal STH. When the first stage starts operation based on the horizontal start signal STH, the stages sequentially output a sampling signal based on o the clock signal CLK.

The sampling latch 320 receives the input image data Idata and sequentially samples first to n-th pixel image data PD1 PDn, which corresponds to one line, among the input image data Idata based on the sampling signal sequentially provided from the stages. The sampling latch 320 outputs the first to n-th pixel image data PD1 to PDn to the holding memory 330 based on a latch signal.

The first to n-th pixel image data PD1 to PDn respectively correspond to images displayed in the pixels PX (refer to FIG. 1), which correspond to one line addressed during one horizontal period.

The holding memory 330 holds the first to n-th pixel image data PD1 to PDn from the sampling latch 320 during one horizontal period, and applies the first to n-th pixel image data PD1 to PDn to the digital-to-analog converter 340 during one horizontal period.

The digital-to-analog converter 340 converts the first to n-th pixel image data PD1 to PDn to the data voltages. The digital-to-analog converter 340 applies the data voltages to the first to n-th buffers BP1 to BPn, respectively.

The first to n-th buffers BP1 to BPn receive the data voltages from the digital-to-analog converter 340 and outputs the data voltages to the data lines DL1 to DLn at the same time point based on the load signal MS.

The data driver 300 further includes a bias signal generating unit 350 and a plurality of bias units. The bias units may include, for example, first to n-th bias units BU1 to BUn provided in one-to-one correspondence with the first to n-th buffers BP1 to BPn.

The bias signal generating unit 350 generates a plurality of bias signals, which include, for example, first and second bias signals BS1 and BS2 which are different from each other. The bias signal generating unit 350 outputs the first and second bias signal BS1 and BS2 to each of the first to n-th bias units BU1 to BUn.

The first to n-th bias units BU1 to BUn respectively generate first to n-th bias currents IB1 to IBn based on the first to n-th pixel image data PD1 to PDn, and respectively apply the first to n-th bias currents IB1 to IBn to the first to n-th buffers BP1 to BPn. For instance, the first bias unit BU1 receives the first pixel image data PD1, generates the first bias current IB1 based on the first pixel image data PD1, and outputs the generated first bias current IB1 to the first buffer BP1.

The first to n-th bias units BU1 to BUn include first to n-th selecting units SU1 to SUn and first to n-th bias current generating units BG1 to BGn.

Each of the first to n-th selecting units SU1 to SUn receives the first and second bias signals BS1 and BS2 from the bias signal generating unit 350. In addition, the first to n-th selecting units SU1 to SUn receive the first to n-th pixel image data PD1 to PDn, respectively. The first to n-th selecting units SU1 to SUn respectively receive, for example, the first to n-th pixel image data PD1 to PDn from the holding memory 330. For example, the first to n-th selecting units SU1 to SUn may respectively receive the first to n-th pixel image data PD1 to PDn from the sampling latch 320.

The first to n-th selecting units SU1 to SUn select either the first bias signal BS1 or the second bias signal BS2 on the first to n-th pixel image data PD1 to PDn, and generate first to n-th final bias signals FBS1 to FBSn. For example, the first to n-th selecting units SU1 to SUn select one of the first and second bias signals in accordance to a variation in the data voltages output from the first to n-th buffers BP1 to BPn in each horizontal period.

For instance, when a level of the data voltage output from the first buffer BP1 varies by a predetermined (e.g., extreme) amount between a (L−1)th horizontal period and an L-th horizontal period following the (L−1)th horizontal period, the first selecting unit SU1 selects one of the first or second bias signals BS1 and BS2 to relatively largely increase the first bias current IB1.

When a level of the data voltage output from the second buffer BP2 varies by an amount less than the predetermined amount (e.g., slightly) between the (L−1)th horizontal period and the L-th horizontal period following the (L−1)th horizontal period, the second selecting unit SU2 selects one of the first or second bias signals BS1 and BS2 to relatively largely increase the second bias current IB2. The predetermined amount may be determined, for example, based on a certain type of desired performance, the intended application, or different criteria.

The first to n-th bias current generating units BG1 to BGn receive the first to n-th final bias signals FBS1 to FBSn from the first to n-th selecting units SU1 to SUn, respectively, to generate the first to n-th bias currents IB1 to IBn based on the first to n-th final bias signals FBS1 to FBSn. The first to n-th bias current generating units BG1 to BGn apply the first to n-th bias currents IB1 to IBn to the first to n-th buffers BP1 to BPn.

Figure 3:
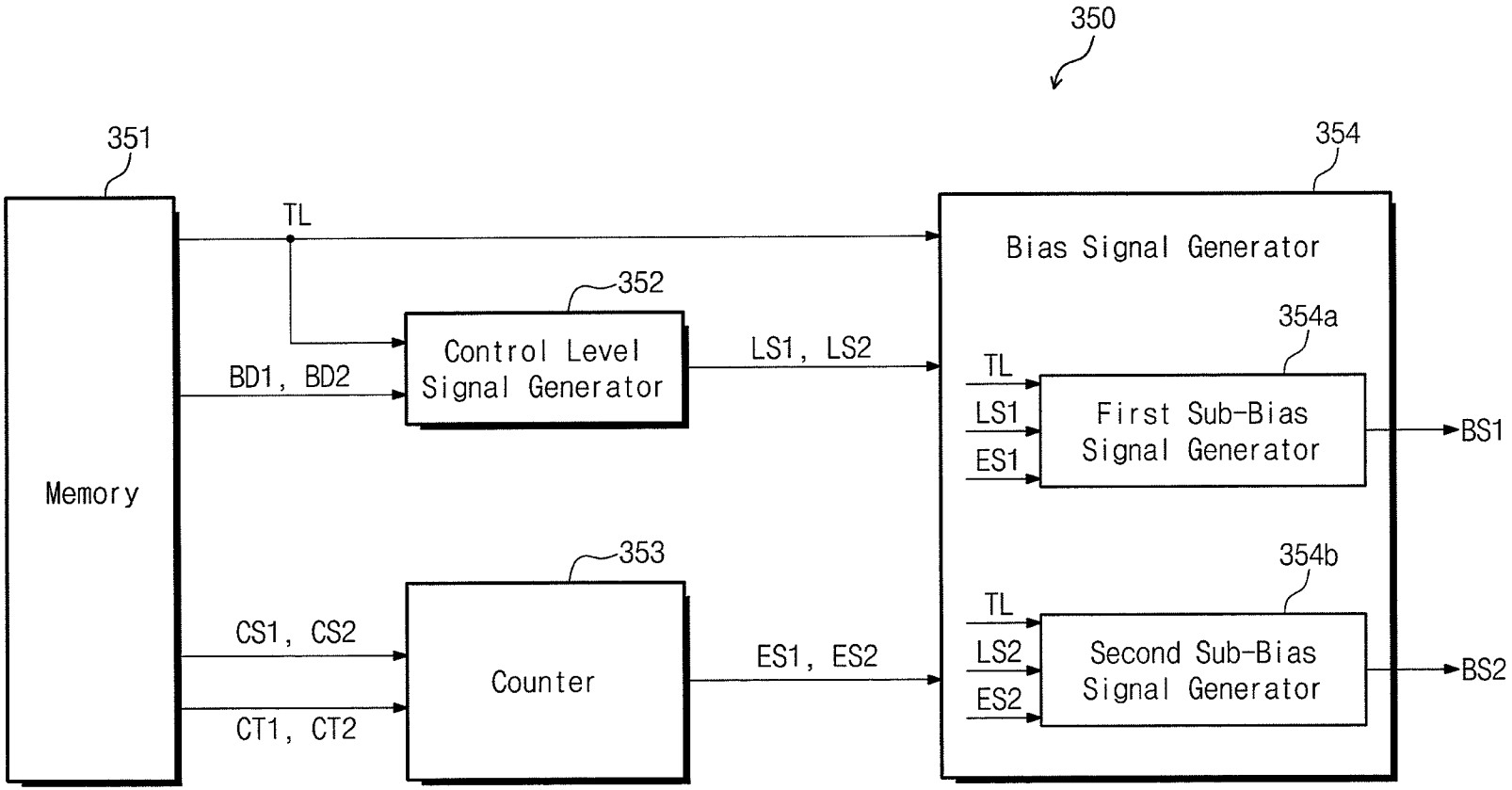
FIG. 3 illustrates an embodiment of a bias signal generating unit.
Figure 4A:
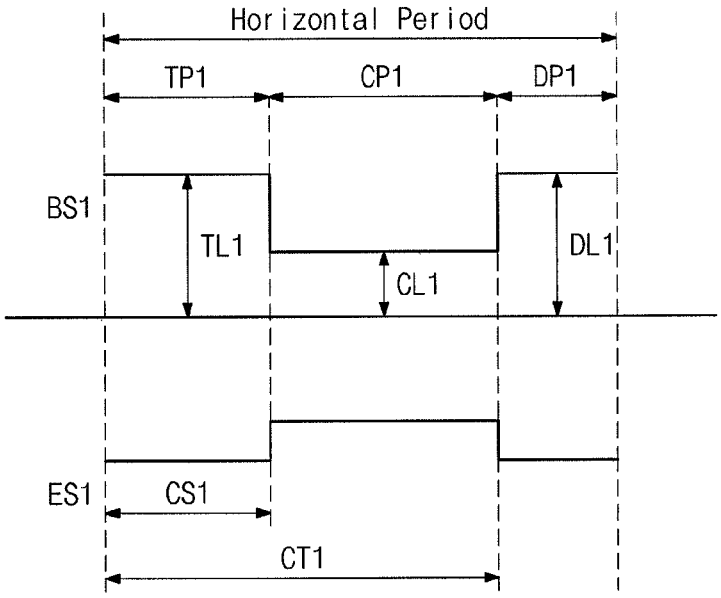
FIGS. 4A and 4B illustrate examples of control signals for the unit in FIG. 3.
Figure 4B:
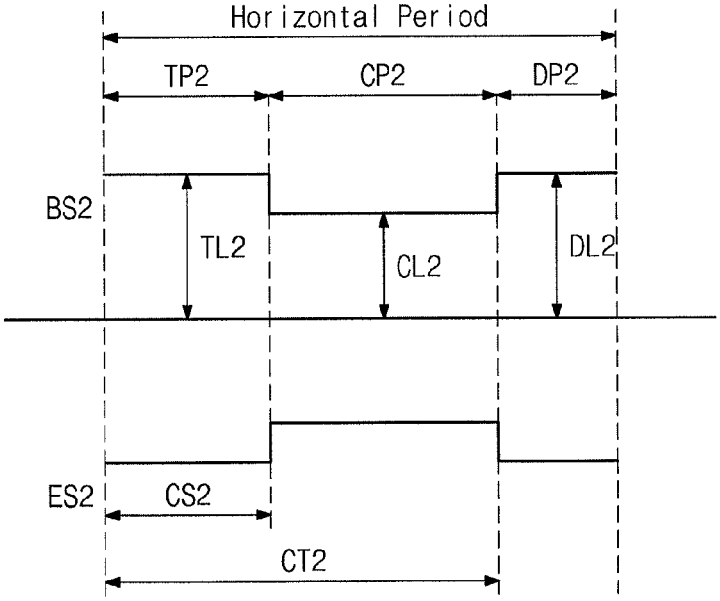

FIG. 3 illustrates an embodiment of the bias signal generating unit 350 in FIG. 2, and FIGS. 4A and 4B are timing diagrams including examples of control signals for the bias signal generating unit 350 in FIG. 3. Waveforms of the first and second bias signals BS1 and BS2 and first and second activation signals ES1 and ES2 will be described with reference to FIGS. 4A and 4B.

The first bias signal BS1 includes a first transition period TP1, a first control period CP1, and a first dummy period DP1, which are defined in each horizontal period. In the present exemplary embodiment, the first transition period TP1, the first control period CP1, and the first dummy period DP1 are arranged in order of the first transition period TP1, the first control period CP1, and the first dummy period DP1 in each horizontal period.

The first transition period TP1, the first control period CP1, and the first dummy period DP1 do not overlap each other. As an example, the first transition period TP1 is defined between a start point of the horizontal period and a start point of the first control period CP1. The first dummy period DP1 is defined between an end point of the first control period CP1 and an end point of the horizontal period.

The first bias signal BS1 has a first transition level TL1 during the first transition period TP1, has a first control level CL1 during the first control period CP1, and has a first dummy level DL1 during the first dummy period DP1. The first transition level TL1 is higher than the first control level CL1. The first dummy level DL1 may be substantially the same as the first transition level TL1.

The second bias signal BS2 includes a second transition period TP2, a second control period CP2, and a second dummy period DP2, which are defined in each horizontal period. In the present exemplary embodiment, the second transition period TP2, the second control period CP2, and the second dummy period DP2 are arranged in order of the second transition period TP2, the second control period CP2, and the second dummy period DP2 in each horizontal period. The second transition period TP2, the second control period CP2, and the second dummy period DP2 do not overlap each other.

As an example, the second transition period TP2 is defined between a start point of the horizontal period and a start point of the second control period CP2. The second dummy period DP2 is defined between an end point of the second control period CP2 and an end point of the horizontal period.

The second bias signal BS2 has a second transition level TL2 during the second transition period TP1, a second control level CL2 during the second control period CP2, and a second dummy level DL2 during the second dummy period DP2. In this embodiment, the second transition level TL2 is higher than the second control level CL2. The second dummy level DL2 may be substantially the same as the second transition level TL2.

As an example, the second transition level TL2 and the second dummy level DL2 are substantially the same as the first transition level TL1 and the first dummy level DL1, respectively, and the second control level CL2 is higher than the first control level CL1. As an example, the second transition period TP2, the second control period CP2, and the second dummy period DP2 may respectively correspond to the first transition period TP1, the first control period CP1, and the first dummy period DP1.

Referring to FIG. 3, the bias signal generating unit 350 includes a memory 351, a control level value generator 352, a counter 353, and a bias signal generator 354.

The memory 351 stores a transition level value TL including information relating to the first and second transition levels TL1 and TL2. In addition, the memory 351 stores first and second bias different values BD1 and BD2 respectively including information about differences between the first and second transition levels TL1 and TL2 and the first and second control levels CL1 and CL2, first and second control start time points CS1 and CS2 including information about the start point of the first and second control periods CP1 and CP2, and first and second control end time points CT1 and CT2 including information about the first and second control periods CP1 and CP2.

The control level value generator 352 receives the transition level value TL and the first and second bias different values BD1 and BD2 from the memory 351. The control level value generator 352 subtracts the first and second bias different values BD1 and BD2 from the transition level value TL, and generates first and second control level values LS1 and LS2 to determine the first and second control levels CL1 and CL2.

The counter 353 receives the clock signal CLK. The counter 353 generates the first activation signal ES1 based on the first control start time point CS1 and the first control end time point CT1 to determine the first control period CP1.

For example, the counter 353 counts a time lapse from the start point of the horizontal period to the first control start time point CS1 using the clock signal CLK to define the first transition period TP1. The counter 353 outputs a low level during the first transition period TP1. Then, the counter 353 counts a time lapse from the start point of the horizontal period to the first control end time point CT1 to define the first control period CP1. The counter 353 outputs a high level during the first control period CP1. Subsequently, the counter 353 outputs the low level during the first dummy period DP1. As a result, the first activation signal ES1 has the low level during the first transition period TP1 and the first dummy period DP1, and has the high level during the first control period CP1.

The counter 353 generates the second activation signal ES2 based on the second control start time point CS2 and the second control end time point CT2 to determine the second control period CP2.

For example, the counter 353 counts a time lapse from the start point of the horizontal period to the second control start time point CS2, using the clock signal CLK to define the second transition period TP2. The counter 353 outputs the low level during the second transition period TP2. Then, the counter 353 counts a time lapse from the start point of the horizontal period to the second control end time point CT2 to define the second control period CP2. The counter 353 outputs the high level during the second control period CP2. Subsequently, the counter 353 outputs the low level during the second dummy period DP2. As a result, the second activation signal ES2 has the low level during the second transition period TP2 and the second dummy period DP2 and has the high level during the second control period CP2.

As described above, since the second transition period TP2, the second control period CP2, and the second dummy period DP2 are defined the same as the first transition period TP1, the first control period CP1, and the first dummy period DP1, respectively, the second control start time point CS2 and the second control end time point CT2 are substantially the same as the first control start time point CS1 and the first control end time point CT1, respectively. Accordingly, the first activation signal ES1 generated based on the first control start time point CS1 and the first control end time point CT1 may have substantially the same waveform as that of the second activation signal ES2 generated based on the second control start time point CS2 and the second control end time point CT2.

The bias signal generator 354 includes a first sub-bias signal generator 354*a* that generates the first bias signal BS1 and a second sub-bias signal generator 354*b* that generates the second bias signal BS2. The first sub-bias signal generator 354*a* receives the transition level value TL, the first control level value LS1, and the first activation signal ES1 and generates the first bias signal BS1 based on the transition level value TL, the first control level value LS1, and the first activation signal ES1. The second sub-bias signal generator 354*b* receives the transition level value TL, the second control level value LS2, and the second activation signal ES2 and generates the second bias signal BS2 based on the transition level value TL, the second control level value LS2, and the second activation signal ES2.

Figure 5:
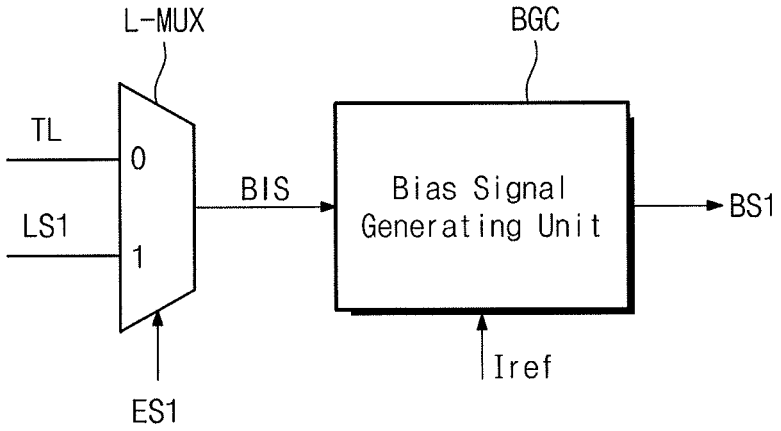
FIG. 5 illustrates an embodiment of a first sub-bias signal generator.

FIG. 5 illustrates an embodiment of the first sub-bias signal generator 354*a*. In one embodiment, the first and second sub-bias signal generators 354*a* and 354*b* may have the same structure and function. Therefore, only the first sub-bias signal generator 354*a* will be described.

Referring to FIG. 5, the first sub-bias signal generator 354*a* includes a level value multiplexer L-MUX and a bias signal generating circuit BGC. The level value multiplexer L-MUX receives the transition level value TL, the first control level value LS1, and the first activation signal ES1. The level value multiplexer L_MUX selects either the transition level value TL or the first control level value LS1 based on the first activation signal ES1 to generate an intermediate bias signal IBS.

For example, the level value multiplexer L-MUX selects the transition level value TL when the first activation signal ES1 is at the low level and selects the first control level value LS1 when the first activation signal ES1 is at the high level to output the intermediate bias signal IBS. As a result, the intermediate bias signal IBS has the transition level value TL during the first transition period TP1 and has the first control level value LS1 during the first control period CP1.

The bias signal generating circuit BGC receives the intermediate bias signal IBS and a reference bias current Iref and generates the first bias signal BS1.

Figure 6:
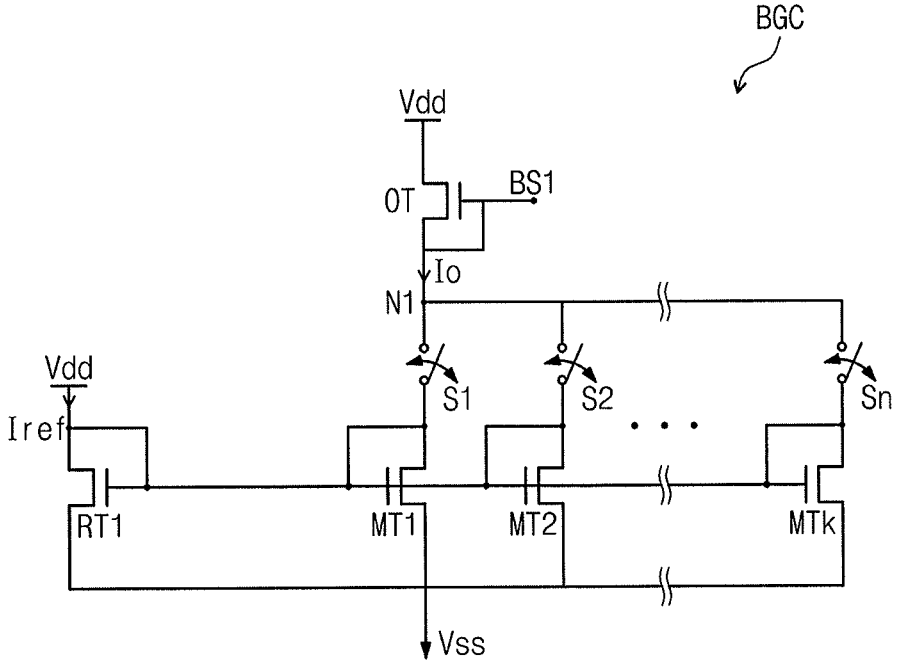
FIG. 6 illustrates an embodiment of a bias signal generating circuit in FIG. 5.

FIG. 6 illustrates an embodiment of the bias signal generating circuit in FIG. 5. Referring to FIG. 6, the bias signal generating circuit BGC includes a reference transistor RT, first to k-th mirror transistors MT1 to MTk, first to k-th switches S1 to Sk, and an output transistor OT.

The source and drain of the reference transistor RT are respectively connected to first and second power sources Vdd and Vss. A gate of the reference transistor RT is connected to the source of the reference transistor RT.

Gates of the first to k-th mirror transistors MT1 to MTk are connected to the gate of the reference transistor RT. The gates of the first to k-th mirror transistors MT1 to MTk are also connected to sources of the first to k-th mirror transistors MT1 to MTk, respectively. The drains of the first to k-th mirror transistors MT1 to MTk are connected the second power source Vss, and are respectively connected to first ends of the first to k-th switches S1 to Sk.

The drain of the output transistor OT is connected to the first power source Vdd. The gate of the output transistor OT is connected to a source of the output transistor OT. The source of the output transistor OT is connected to second ends of the first to k-th switches S1 to Sk. The nodes, at which the source of the output transistor OT is connected to the other ends of the first to k-th switches S1 to Sk, will be referred to as first nodes N1.

The first to k-th switches S1 to Sk are switched on or off in accordance of the level of the intermediate bias signal IBS.

When the reference bias current Iref is applied to the reference transistor RT, the first to k-th mirror transistors MT1 to MTk respectively generate first to k-th mirror currents by a current mirroring operation. However, the first to k-th mirror currents flow from the first nodes N1 through the source and the drain of the first to k-th mirror transistors MT1 to MTk when the first to k-th switches S1 to Sk are switched on. For instance, the first mirror current flows from the first node N1 through the source and the drain of the first mirror transistor MT1 when the first switch S1 is switched on.

When the switches corresponding to the first to k-th mirror currents are switched on, the mirror currents flowing through the first nodes N1 are added to each other to form an output current Io. The output current Io flows through the source and the drain of the output transistor OT.

The first to k-th mirror currents have different values. For instance, when the first to k-th mirror transistors MT1 to MTk have different sizes, the first to k-th mirror currents have different values.

The output current Io has a value controlled by the combination of the switched-on and off of the first to k-th switches S1 to Sk due to the intermediate bias signal IBS. For example, the switched-on and off of each of the first to k-th switches are determined to allow the value of the output current Io to correspond to the intermediate bias signal IBS. When the output current Io flows through the output transistor OT, the output transistor OT outputs the first bias signal BS1 corresponding to the output current Io through the gate thereof.

The bias signal generating circuit BGC may further include a current source. The first end of the current source is connected to the first power source Vdd, and the second end of the current source is connected to the reference transistor RT. The current source may apply the reference bias current Iref to the reference transistor RT. In another embodiment, a resistor may be used, instead of the current source, to apply the reference bias current Iref to the reference transistor RT. The resistor may be connected, for example, between the first power source Vdd and the reference transistor RT. In this case, the reference bias current Iref may have a value determined, for example, by a resistance of the resistor.

Figure 7A:
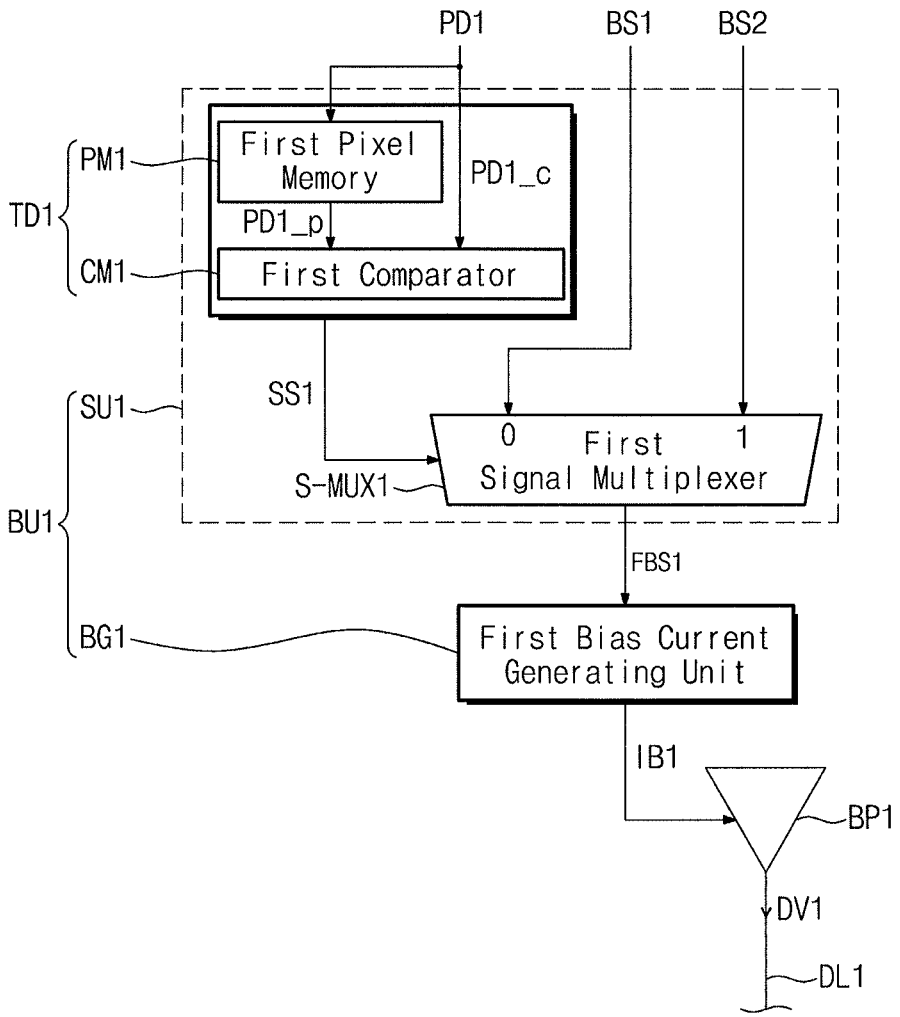
FIGS. 7A and 7B illustrate embodiments of first and second bias units in FIG. 2.
Figure 7B:
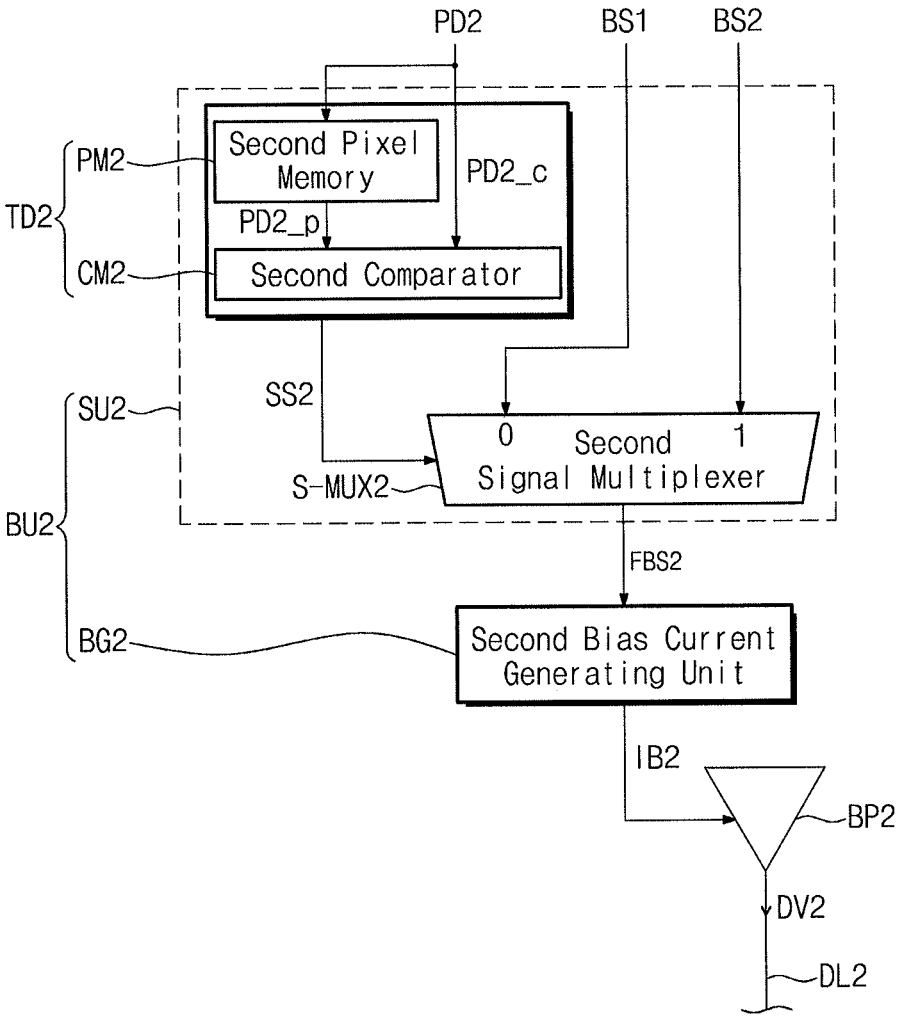

FIGS. 7A and 7B respectively illustrate embodiments of first and second bias units BU1 and BU2 in FIG. 2. The first bias unit BU1 includes the first selecting unit SU1 and the first bias current generating unit BG1.

The first selecting unit SU1 includes a first variation detector TD1 and a first signal multiplexer S-MUX1. The first variation detector TD1 receives the first pixel image data PD1 and generates a first selection signal SS1 based on the first pixel image data PD1. The first variation detector TD1 includes a first pixel memory PM1 and a first comparator CM1.

The first pixel image data PD1 includes a previous first pixel image data PD1_*p* provided in the (L−1)th horizontal period and a present first pixel image data PD1_*c* provided in the L-th horizontal period. The L-th horizontal period follows the (L−1)th horizontal period.

The first pixel memory PM1 stores the pervious first pixel image data PD1_*p* and applies the pervious first pixel image data PD1_*p* to the first comparator CM1. The first pixel memory PM1 receives the first pixel image data PD1_*p* during the (L−1)th horizontal period and stores the first pixel image data PD1_*p* therein. Then, the first pixel memory PM1 applies the pervious first pixel image data PD1_*p* to the first comparator CM1 during the L-th horizontal period.

The first comparator CM1 compares the previous first pixel image data PD1_*p* and the present first pixel image data PD1_*c* to generate the first selection signal SS1. As an example, the first comparator CM1 calculates an absolute value of a difference between a previous grayscale value of the previous first pixel image data PD1_*p* and a present grayscale value of the present first pixel image data PD1_*c* and generates the first selection signal SS1 based on the absolute value of the difference between the previous grayscale value and the present grayscale value.

As an example, the first comparator CM1 compares an upper 1 bit of the present first pixel image data PD1_*c* with an upper 1 bit of the previous first pixel image data PD1_*p*, in order to calculate the difference between the previous grayscale value of the previous first pixel image data PD1_*p* and the present grayscale value of the present first pixel image data PD1_*c*. The first comparator CM1 receives the upper 1 bit of the present first pixel image data PD1_*c* and the upper 1 bit of the previous first pixel image data PD1_*p*, and performs an exclusive-OR calculation on the upper 1 bit to output the first selection signal SS1.

When assuming that the difference between the previous grayscale value and the present grayscale value is large (e.g., the previous grayscale value corresponds to 10 grayscale level among 256 grayscale levels and the present gray scale value corresponds to 255 grayscale level among 256 grayscale levels), the upper 1 bit of the previous first pixel image data PD1_*p* has a value of "0" and the upper 1 bit of the present first pixel image data PD1_*c* has a value of "1". Accordingly, the first selection signal SS1 has the value of "1" when the exclusive-OR calculation is performed.

On the contrary, when assuming that the difference between the previous grayscale value and the present grayscale value is small (e.g., the previous grayscale value corresponds to 255 grayscale level among 256 grayscale levels and the present gray scale value corresponds to 255 grayscale level among 256 grayscale levels), the upper 1 bit of the previous first pixel image data PD1_*p* has the value of "1" and the upper 1 bit of the present first pixel image data PD1_*c* has the value of "0". Therefore, the first selection signal SS1 has the value of "0" when the exclusive-OR calculation is performed.

The first signal multiplexer S-MUX1 receives the first and second bias signals BS1 and BS2 from the bias signal generating unit 350 and receives the first selection signal SS1 from the first comparator CM1. The first signal multiplexer S-MUX1 selects one of the first and second bias signals BS1 and BS2 based on the first selection signal SS1 and outputs the selected bias signal of the first and second bias signals BS1 and BS2 as the first final bias signal FBS1. For instance, when the first selection signal SS1 has the value of "0", the first signal multiplexer S-MUX1 selects the first bias signal BS1 and when the first selection signal SS1 has the value of "1", the first signal multiplexer S-MUX1 selects the second bias signal BS2.

The first bias current generating unit BG1 receives the first final bias signal FBS1 from the first signal multiplexer S-MUX1 and generates the first bias current IB1 based on the first final bias signal FBS1. The first bias current generating unit BG1 applies the first bias current IB1 to the first buffer BP1 (e.g., refer to FIG. 2).

The first bias current generating unit BG1 generates the first bias current IB1 having the same value as that of the output current Io through the current mirroring operation using the transistors shown in FIG. 6.

The second bias unit BU2 includes the second selecting unit SU2 and the second bias current generating unit BG2. The second selecting unit SU2 includes a second variation detector TD2 and a second signal multiplexer S-MUX2. The second variation detector TD2 receives the second pixel image data PD2 and generates a second selection signal SS2 based on the second pixel image data PD2. The second variation detector TD2 includes a second pixel memory PM2 and a second comparator CM2.

The second pixel image data PD2 includes a previous second pixel image data PD2_*p* provided in the (L−1)th horizontal period and a present second pixel image data PD2_*c* provided in the L-th horizontal period.

The second pixel memory PM2 stores the pervious second pixel image data PD2_*p* and applies the pervious second pixel image data PD2_*p* to the second comparator CM2. The second pixel memory PM2 receives the second pixel image data PD2_*p* during the (L−1)th horizontal period and stores the second pixel image data PD2_*p* therein. Then, the second pixel memory PM2 applies the pervious second pixel image data PD2_*p* to the second comparator CM2 during the L-th horizontal period.

The second comparator CM2 compares the previous second pixel image data PD2_*p* and the present second pixel image data PD2_*c* to generate the second selection signal SS2. As an example, the second comparator CM2 calculates an absolute value of a difference between a previous grayscale value of the previous second pixel image data PD2_*p* and a present grayscale value of the present second pixel image data PD2_*c* and generates the selection signal SS2 based on the absolute value of the difference between the previous grayscale value and the present grayscale value. Operation of the second comparator CM2 may be substantially the same as that of the first comparator CM1, except that the second comparator CM2 receives the previous second pixel image data PD2_p and the present second pixel image data PD2_c.

The second signal multiplexer S-MUX2 receives the first and second bias signals BS1 and BS2 from the bias signal generating unit 350 and receives the second selection signal SS2 from the second comparator CM2. The second signal multiplexer S-MUX2 selects one of the first or second bias signals BS1 and BS2 based on the second selection signal SS2, and outputs the selected bias signal of the first and second bias signals BS1 and BS2 as the second final bias signal FBS2. For instance, when the second selection signal SS2 has the value of "0", the second signal multiplexer S-MUX2 selects the first bias signal BS1 and when the second selection signal SS2 has the value of "1", the second signal multiplexer S-MUX2 selects the second bias signal BS2.

The second bias current generating unit BG2 receives the second final bias signal FBS2 from the second signal multiplexer S-MUX2 and generates the second bias current IB2 based on the second final bias signal FBS2. The second bias current generating unit BG2 applies the second bias current IB2 to the second buffer BP1 (refer to FIG. 2). The second bias current generating unit BG2 generates the second bias current IB2 having the same value as that of the output current Io through the current mirroring operation using the transistors shown in FIG. 6.

Figure 8:
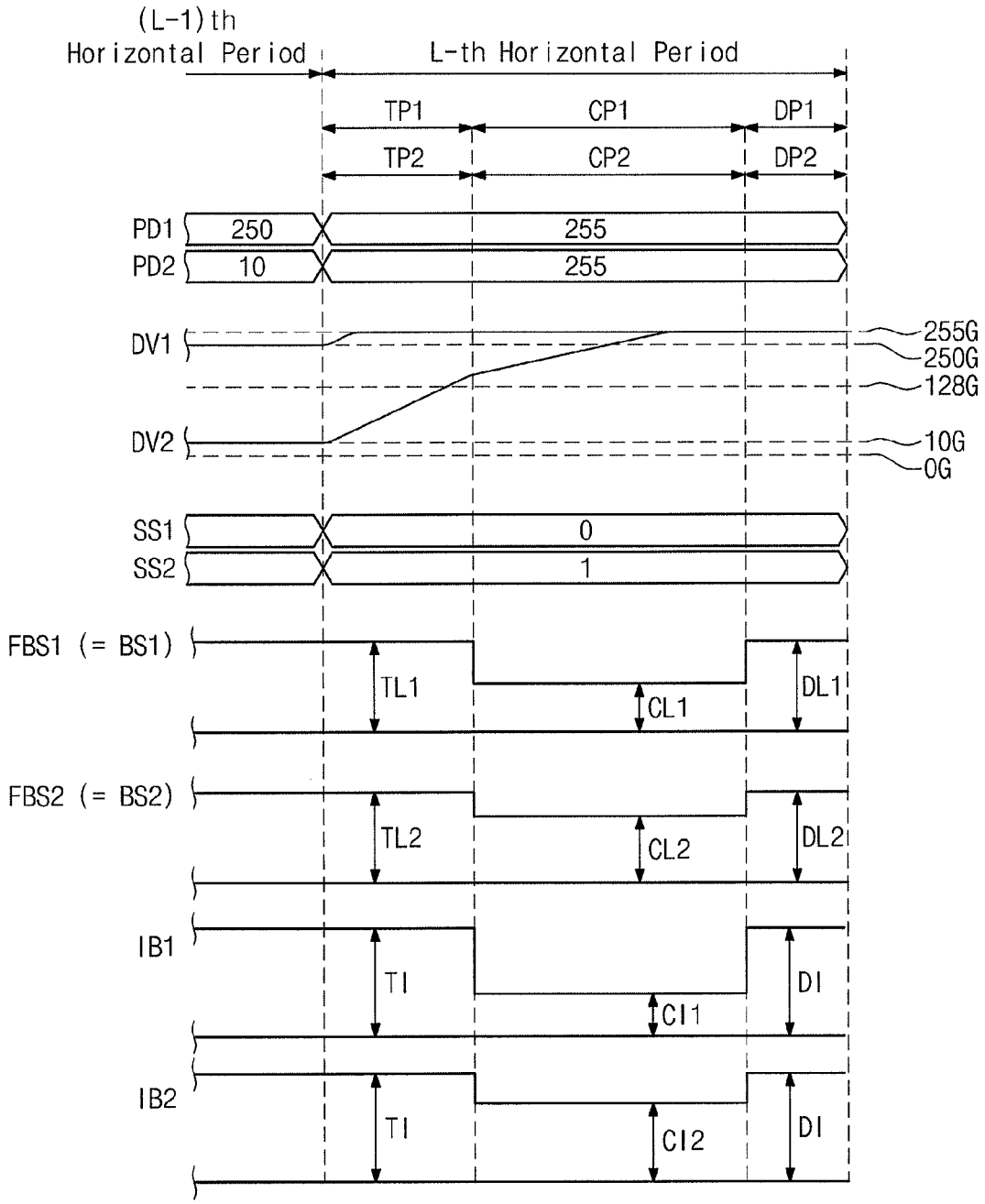
FIG. 8 illustrates examples of control signals for the units in FIGS. 7A and 7B.

FIG. 8 is a timing diagram illustrating examples of control signals for the units in FIGS. 7A and 7B. In the present exemplary embodiment, the previous grayscale value of the previous first pixel image data PD1_p corresponds to 250 grayscale level among 256 grayscale levels and the present grayscale value of the present first pixel image data PD1_c corresponds to 255 grayscale level among 256 grayscale levels.

The first buffer BP1 (e.g., in FIG. 2) outputs a first data voltage DV1 corresponding to the first pixel image data PD1. For example, the first data voltage DV1 has a first voltage 250G corresponding to 250 grayscale level during the (L−1)th horizontal period and has a second voltage 255G during the first control period CP1 of the L-th horizontal period according to the present grayscale value of the first pixel image data PD1 corresponding to 255 grayscale level. Thus, a variation (or difference) of the first data voltage DV1 is small during the horizontal period.

The previous grayscale value of the previous second pixel image data PD2_p corresponds to 10 grayscale level among 256 grayscale levels and the present grayscale value of the present second pixel image data PD2_c corresponds to 255 grayscale level among 256 grayscale levels.

The second buffer BP2 output a second data voltage DV2. The second data voltage DV2 has a third voltage 10G corresponding to 10 grayscale level during the (L−1)th horizontal period and has the second voltage 255G during the second control period CP2 of the L-th horizontal period. Thus, a variation (or difference) of the second data voltage DV2 is large during the horizontal period.

As described with reference to FIGS. 4A and 4B, the first and second bias signals BS1 and BS2 have substantially the same level, except that the first and second bias signals BS1 and BS2 respectively have the first and second control levels CL1 and CL2. For example, the first transition period TP1, the first control period CP1, and the first dummy period DP1 are substantially the same as the second transition period TP2, the second control period CP2, and the second dummy period DP2, respectively. Also, the first transition level TL1 and the first dummy level DL1 are substantially the same as the second transition level TL2 and the second dummy level DL2, respectively.

The first variation detector TD1 calculates the difference between the previous grayscale value of the previous first pixel image data PD1_p and the present grayscale value of the present first pixel image data PD1_c, to generate the first selection signal SS1 having the value of "0". The first signal multiplexer S-MUX1 selects the first bias signal BS1 based on the first selection signal SS1. Then, the first selecting unit SU1 outputs the selected first bias signal BS1 as the first final bias signal FBS1 during the L-th horizontal period.

The second variation detector TD2 calculates the difference between the previous grayscale value of the previous second pixel image data PD2_p and the present grayscale value of the present second pixel image data PD2_c, to generate the second selection signal SS2 having the value of "1". The second signal multiplexer S-MUX2 selects the second bias signal BS2 having the relatively high level in the second control period CP2 based on the second selection signal SS2. Then, the second selecting unit SU2 outputs the selected second bias signal BS2 as the second final bias signal FBS2 during the L-th horizontal period.

The first bias current generating unit BG1 generates the first bias current IB1 based on the first final bias signal FBS1. The second bias current generating unit BG2 generates the second bias current IB2 based on the second final bias signal FBS2. Accordingly, the first and second bias currents IB1 and IB2 have a transition current TI corresponding to the first transition level TL1, which is equal to the second transition level TL2, during the first transition period TP1 and the second transition period TP2. In addition, the first and second bias currents IB1 and IB2 have a dummy current DI corresponding to the first dummy level DL1, which is equal to the second dummy level DL2, during the first dummy period DP1 and the second dummy period DP2.

However, the first bias current IB1 has a first control current CI1 corresponding to the first control level CL1 during the first control period CP1 and the second control period CP2. The second bias current IB2 has a second control current CI2 corresponding to the second control level CL2 during the first control period CP1 and the second control period CP2.

Since the first control current CI1 is smaller than the second control current CI2, a power consumption in the first and second buffers BP1 and BP2 when the first control current CI1 is applied to the first and second buffers BP1 and BP2 is smaller than a power consumption in the first and second buffers BP1 and BP2 when the second control current CI2 is applied to the first and second buffers BP1 and BP2.

In addition, since the first control current CI1 is smaller than the second control current CI2, a through rate of the first and second buffers BP1 and BP2 when the first control current CI1 is applied to the first and second buffers BP1 and BP2 is smaller than a through rate in the first and second buffers BP1 and BP2 when the second control current CI2 is applied to the first and second buffers BP1 and BP2.

The first bias current IB1 is applied to the first buffer BP1 and the second bias current IB2 is applied to the second buffer BP2 that outputs the second data voltage DV2 extremely varied according to the horizontal period.

Since the first control current CI1 smaller than the second control current CI2 is applied to the first buffer BP1 during the first and second control periods CP1 and CP2, the power consumption in the first buffer BP1 is more reduced than the power consumption in the second buffer BP2.

Further, since the second control current CI2 greater than the first control current CI1 is applied to the second buffer BP2, the second buffer BP2 may secure the through rate enough to output the second data voltage DV2 that is relatively greatly varied. For example, since the variation in amount of the second data voltage DV2 is large, the first data voltage DV1 increases to the second voltage 255G at the start point of the first control period CP1, but the second data voltage DV2 does not increase to the second voltage 255G. The second control current CI2 is applied to the second buffer BP2 during the first control period CP1, and thus the second data voltage DV2 rapidly increases to the second voltage 255G.

The second buffer BP2 may increase the second data voltage DV2 to the second voltage 255G in the first control period CP1 using only the through rate corresponding to the transition current TI.

As described above, each of the first and second bias units BU1 and BU2 selects one of the first or second bias signals BS1 and BS2 in accordance with the first and second pixel image data PD1 and PD2, and outputs the bias current corresponding to the selected bias signal of the first and second bias signals BS1 and BS2. Therefore, the first and second buffers BP1 and BP2 are respectively applied with the first and second bias currents IB1 and IB2, which respectively correspond to the first and second data voltages DV1 and DV2 and which have through rates corresponding to variations in the amount of the first and second data voltages DV1 and DV2. As a result, power consumption in the first and second buffers BP1 and BP2 may be reduced.

In addition, a layout of the data driver 300 may be simplified since the data driver 300 includes only one bias signal generating unit 350 having a complex circuit configuration. Also, the first to n-th buffers BP1 to BPn respectively include the first and n-th bias units BU1 to Bun, each having a simple circuit configuration for selecting one of the first or second bias signals BS1 and BS2 generated by the bias signal generating unit 350.

The first and second bias units all and BU2 have been described as a representative example. In one embodiment, the first to n-th bias units BU1 to BUn may have the same structure and function.

Figure 9:
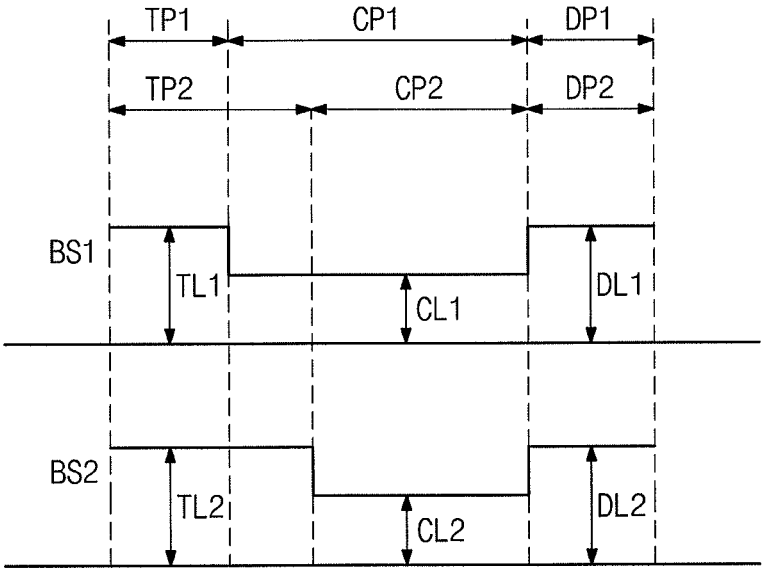
FIG. 9 illustrates additional examples of control signals for the unit of FIG. 3.
Figure 10:
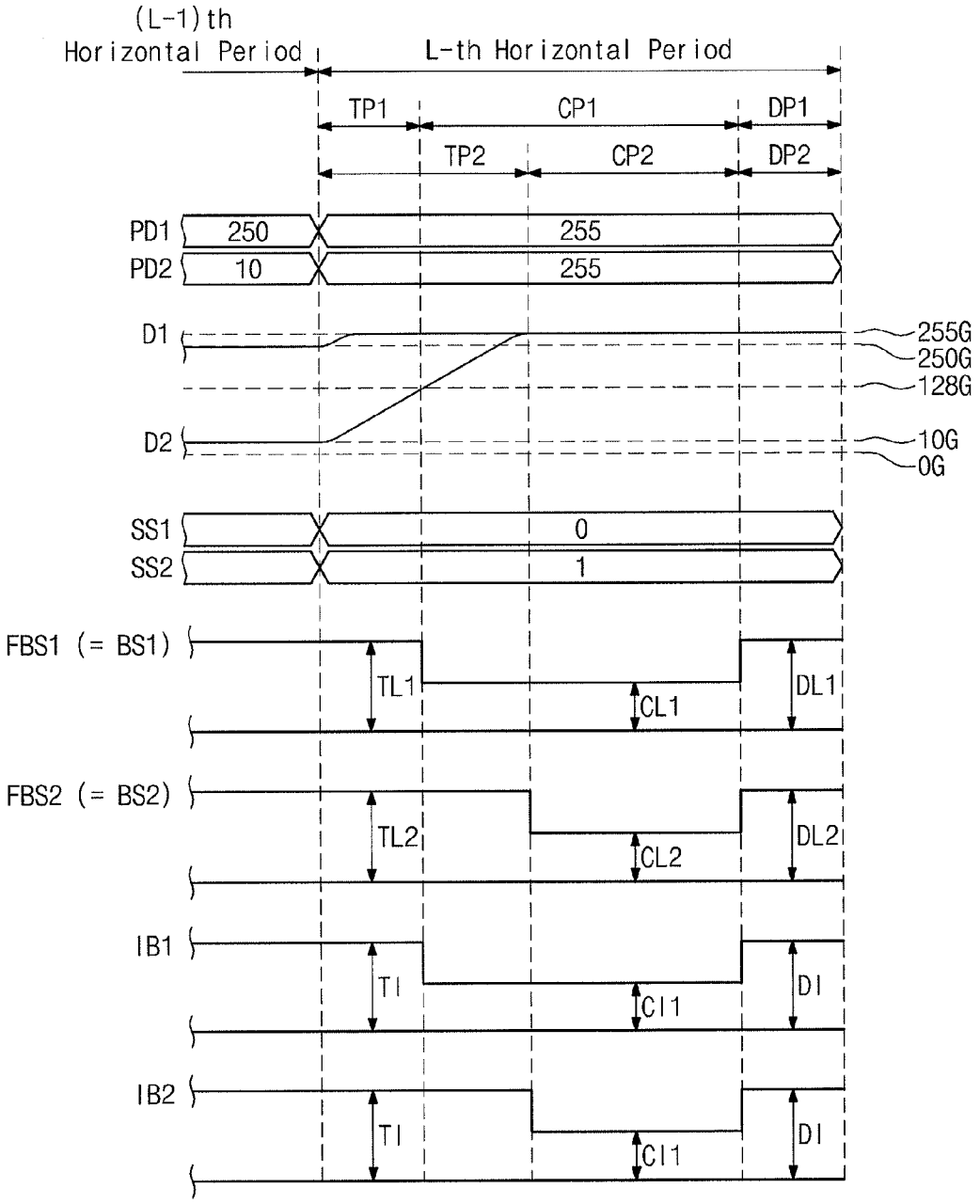
FIG. 10 illustrates additional examples of control signals for the units in FIGS. 7A and 7B.

FIG. 9 is a timing diagram illustrating additional examples of control signals for the unit in FIG. 3, and FIG. 10 is a timing diagram illustrating examples of control signals for the units in FIGS. 7A and 7B.

Referring to FIG. 9, the first and second control periods CP1 and CP2 are defined to be different from each other. For example, at least a portion of the first control period CP1 does not overlap the second control period CP2. In one embodiment, the width of the first control period CP1 is greater than that of the second control period CP2, and the end point of the first control period CP1 is substantially coincident with the end point of the second control period CP2. Thus, the start point of the first control period CP1 is faster than the start point of the second control period CP2.

According to another exemplary embodiment, at least a portion of the second control period CP2 may not overlap the first control period CP1. According to another exemplary embodiment, the first and second control periods CP1 and CP2 may have the same width, but may start at different start points.

Also, in the present exemplary embodiment, the first transition level TL1, the first control level CL1, and the first dummy level DL1 may be substantially the same as the second transition level TL2, the second control level CL2, and the second dummy level DL2, respectively.

Hereinafter, the operation of the data driver 300 according to another embodiment will be described with reference to FIGS. 7A, 7B, and 10. The first and second data voltages DV1 and DV2, the first and second pixel image data PD1 and PD2, and the first and second selection signals SS1 and SS2 in FIG. 10 may correspond to the description relating to FIGS. 7A and 7B.

The first signal multiplexer S-MUX1 selects the first bias signal BS1 having the first control period CP1 with the relatively large width based on the first selection signal SS1. Then, the first selecting unit SU1 outputs the selected first bias signal BS1 as the first final bias signal FBS1 in the L-th horizontal period.

The second signal multiplexer S-MUX2 selects the second bias signal BS2 having the second control period CP2 with the relatively small width based on the second selection signal SS2. Then, the second selecting unit SU2 outputs the selected second bias signal BS2 as the second final bias signal FBS2 in the L-th horizontal period.

The first bias current generating unit BG1 generates the first bias current IB1 based on the first final bias signal FBS1, and the second bias current generating unit BG2 generates the second bias current IB2 based on the second final bias signal FBS2. The first bias current IB1 has the transition current TI, the first control current CI1, and the dummy current DI respectively during the first transition period TP1, the first control period CP1, and the first dummy period DP1. The second bias current IB2 has the transition current TI, the first control current CI1, and the dummy current DI respectively during the second transition period TP2, the second control period CP2, and the second dummy period DP2.

Since the transition current TI is greater than the first control current CI1, power consumption in the first and second buffers BP1 and BP2, when the transition current TI is applied to the first and second buffers BP1 and BP2, is greater than the power consumption in the first and second buffers BP1 and BP2 when the first control current CI1 is applied to the first and second buffers BP1 and BP2.

In addition, since the transition current TI is greater than the first control current CI1, the through rate of the first and second buffers BP1 and BP2, when the transition current TI is applied to the first and second buffers BP1 and BP2, is greater than the through rate in the first and second buffers BP1 and BP2 when the first control current CI1 is applied to the first and second buffers BP1 and BP2.

The first bias current IB1 is applied to the first buffer BP1 and the second bias current IB2 is applied to the second buffer BP2, that outputs the second data voltage DV2 which extremely varies according to the horizontal period.

Since the transition current TI is applied to the first buffer BP1 during the first transition period TP1 having the width smaller than that of the second transition period TP2, and the first control current CI1 is applied to the first buffer BP1 during the first control period CP1 having the width greater than that of the second control period CP2, power consumption in the first buffer BP1 is reduced more than power consumption in the second buffer BP2.

In addition, since the transition current TI is applied to the second buffer BP2 during the second transition period TP2 having the width greater than that of the first transition period TP1, the second buffer BP2 may secure the through rate corresponding to the first transition current TI during a time period sufficient enough to output the second data voltage DV2, that is relatively greatly varied.

Therefore, the first and second buffers BP1 and BP2 are respectively applied with the first and second bias currents IB1 and IB2 respectively corresponding to the first and second data voltages DV1 and DV2, and have the through rates corresponding to variations in the amounts of the first and second data voltages DV1 and DV2. As a result, power consumption in the first and second buffers BP1 and BP2 may be reduced.

In the above-mentioned description, the first and second bias units BU1 and BU2 have been described as a representative example. In one embodiment, the first to n-th bias units BU1 to BUn may have the same structure and function.

Figure 11:
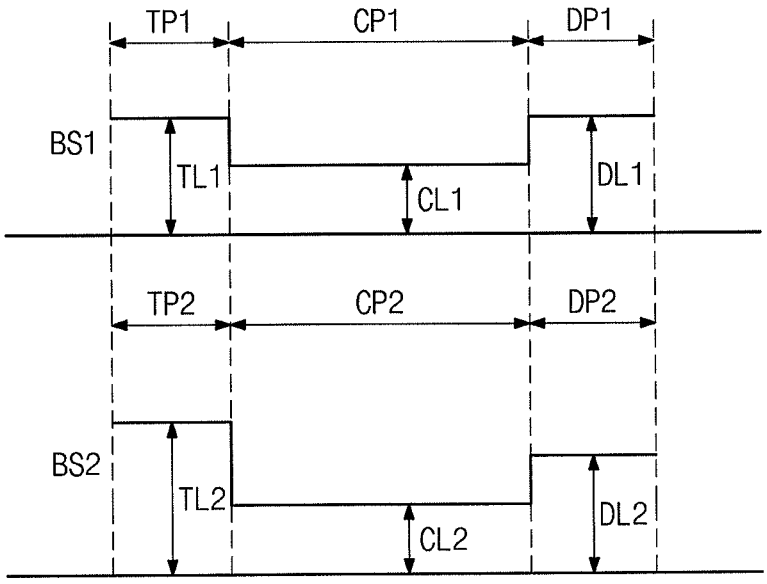
FIG. 11 illustrates additional examples of control signals for the unit in FIG. 3.
Figure 12:
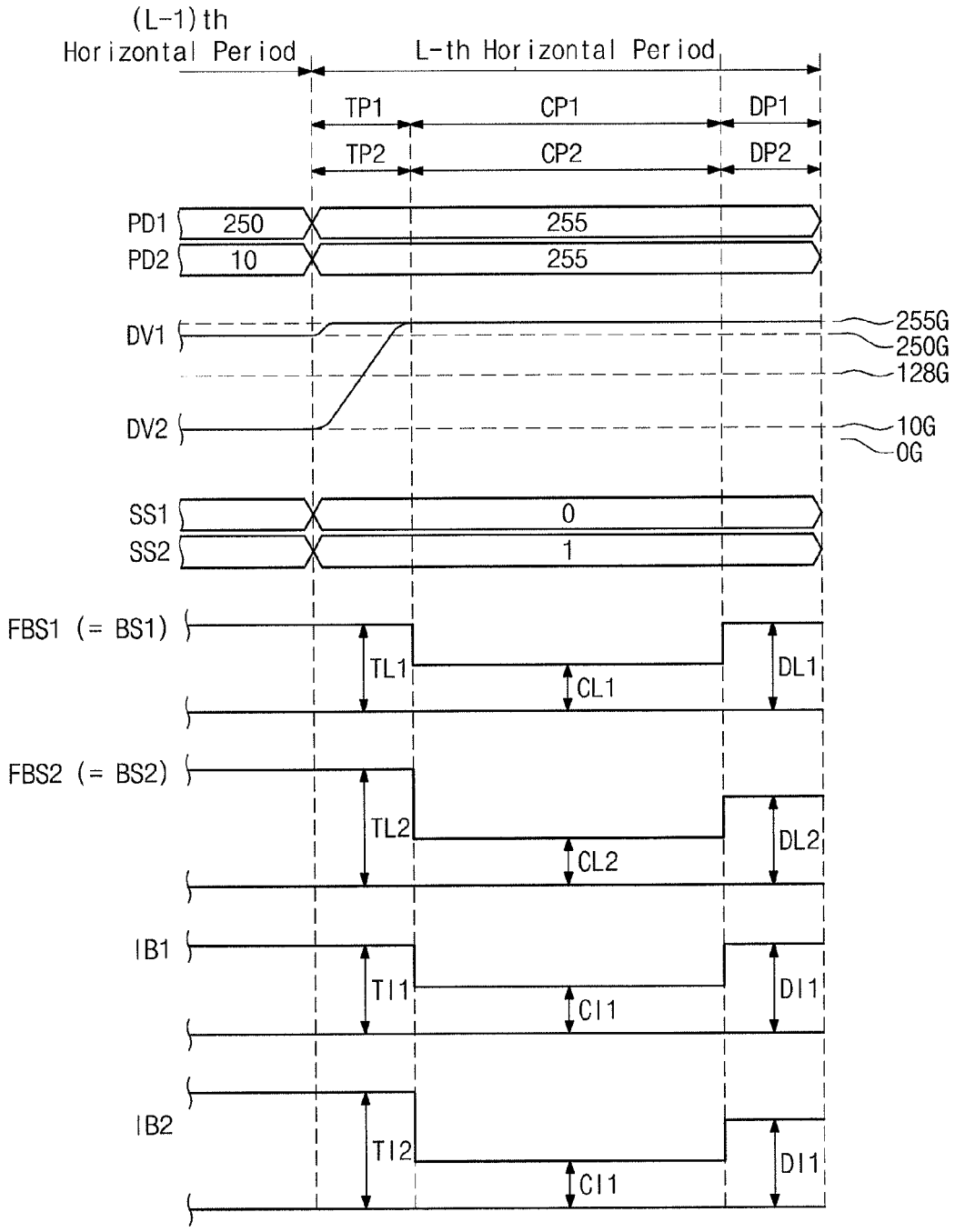
FIG. 12 illustrates additional examples of control signals for the units in FIGS. 7A and 7B.

FIG. 11 is a timing diagram illustrating additional examples of control signals for the unit in FIG. 3, and FIG. 12 is a timing diagram illustrating additional examples of control signals for the units in FIGS. 7A and 7B. Referring to FIG. 11, the first and second transition levels TL1 and TL2 may be defined to be different from each other. Also, in the present exemplary embodiment, the second transition level TL2 is higher than the first transition level TL1.

For example, the first dummy level DL1 may be lower than the first transition level TL1. The second control level CL2 and the second dummy level DL2 may be substantially the same as the first control level CL1 and the first dummy level DL2, respectively. Also, the first transition period TP1, the first control period CP1, and the first dummy period DP1 may be substantially the same as the second transition period TP2, the second control period CP2, and the second dummy period DP2, respectively.

Hereinafter, operation of the data driver 300 will be described with reference to FIGS. 7A, 7B, and 12. The first and second data voltages DV1 and DV2, the first and second pixel image data PD1 and PD2, and the first and second selection signals SS1 and SS2 in FIG. 12 may correspond to the description relating to FIGS. 7A and 7B.

The first signal multiplexer S-MUX1 selects the first bias signal BS1 having the relatively high level in the first transition period TP1 based on the first selection signal SS1. Then, the first selecting unit SU1 outputs the selected first bias signal BS1 as the first final bias signal FBS1 in the L-th horizontal period.

The second signal multiplexer S-MUX2 selects the second bias signal BS2 having the second control period CP2 with the relatively small width in the first transition period TP1 based on the second selection signal SS2. Then, the second selecting unit SU2 outputs the selected second bias signal BS2 as the second final bias signal FBS2 in the L-th horizontal period.

The first bias current generating unit BG1 generates the first bias current IB1 based on the first final bias signal FBS1, and the second bias current generating unit BG2 generates the second bias current IB2 based on the second final bias signal FBS2. Accordingly, the first bias current IB1 has the first transition current TI1 corresponding to the first transition level TL1 during the first transition period TP1, the first control current CI1 during the first control period CP1, and the first dummy current DI1 corresponding to the first dummy level DL1 during the first dummy period DP1.

In addition, the second bias current IB2 has the second transition current TI2 corresponding to the second transition level TL2 during the second transition period TP2, the first control current CI1 during the second control period CP2, and the first dummy current DI1 during the first dummy period DP1.

Since the first transition current TI1 is smaller than the second transition current TI2, power consumption in the first and second buffers BP1 and BP2, when the first transition current TI1 is applied to the first and second buffers BP1 and BP2, is smaller than power consumption in the first and second buffers BP1 and BP2 when the second transition current TI2 is applied to the first and second buffers BP1 and BP2.

In addition, since the first transition current TI1 is smaller than the second transition current TI2, the through rate of the first and second buffers BP1 and BP2, when the first transition current TI1 is applied to the first and second buffers BP1 and BP2, is smaller than the through rate in the first and second buffers BP1 and BP2 when the second transition current T12 is applied to the first and second buffers BP1 and BP2.

The first bias current IB1 is applied to the first buffer BP1 that outputs the first data voltage DV1 slightly varied during the horizontal period, and the second bias current IB2 is applied to the second buffer BP2 that outputs the second data voltage DV2 extremely varied during the horizontal period.

Therefore, since the first transition current TI1 smaller than the second transition current TI2 is applied to the first buffer BP1 during the first and second transition periods TP1 and TP2, power consumption in the first buffer BP1 is reduced to a greater extent than power consumption in the second buffer BP2. In addition, since the second transition current TI2 greater than the first transition current TI1 is applied to the second buffer BP2, the second buffer BP2 may secure a through rate sufficient enough to output the second data voltage DV2, that is relatively greatly varied.

As described above, each of the first and second bias units BU1 and BU2 selects one of the first and second bias signals BS1 and BS2 in accordance with the first and second pixel image data PD1 and PD2, and outputs the bias current corresponding to the selected bias signal of the first and second bias signals BS1 and BS2.

Therefore, the first and second buffers BP1 and BP2 are respectively applied with the first and second bias currents IB1 and IB2, that respectively correspond to the first and second data voltages DV1 and DV2, and have through rates corresponding to variations in the amount of the first and second data voltages DV1 and DV2. As a result, power consumption in the first and second buffers BP1 and BP2 may be reduced.

In the above-mentioned description, the first and second bias units BU1 and BU2 have been described as a representative example. In one embodiment, the first to n-th bias units BU1 to BUn may have the same structure and function.

Figure 13:
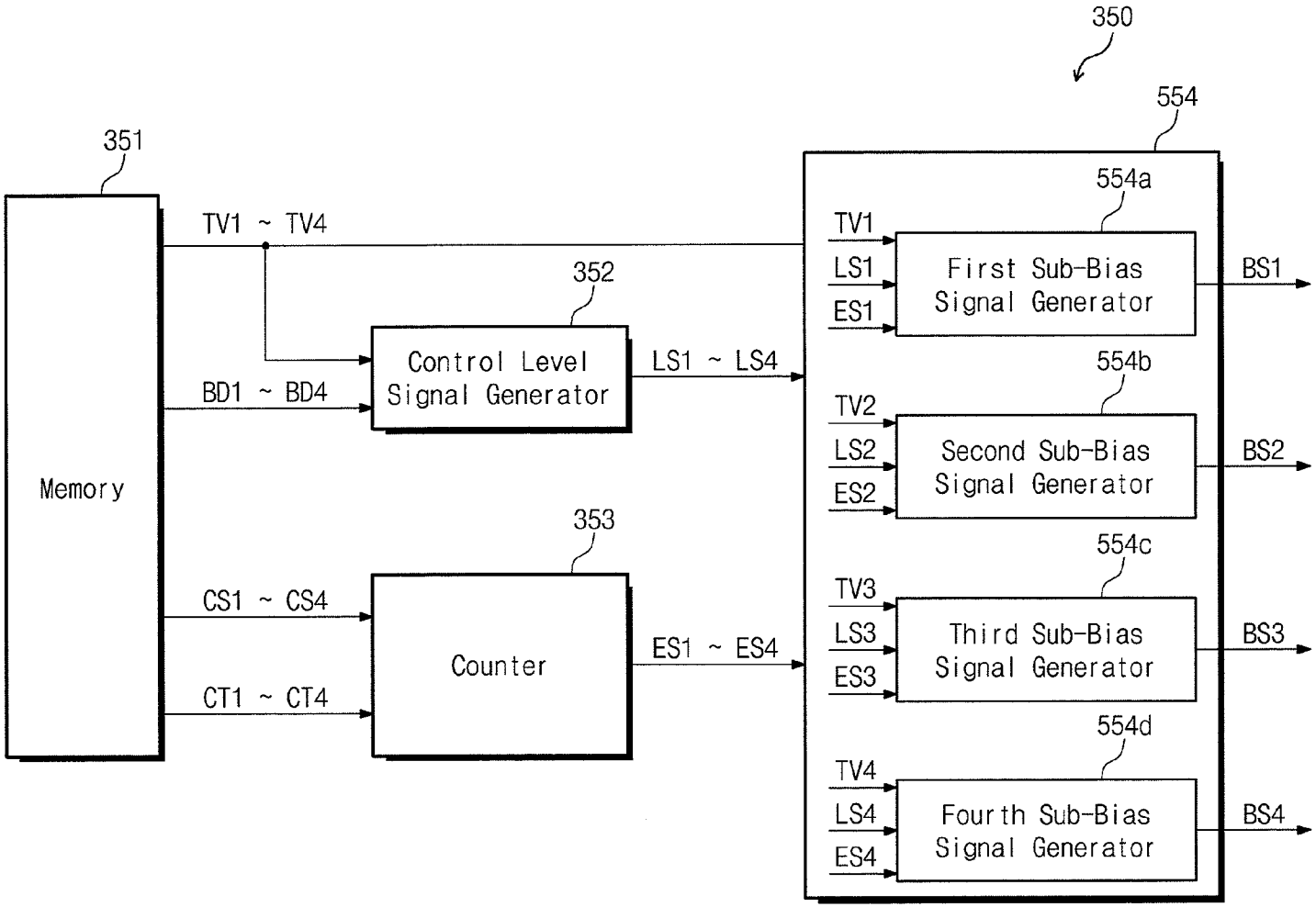
FIG. 13 illustrates another embodiment of a bias signal generating unit.
Figure 14:
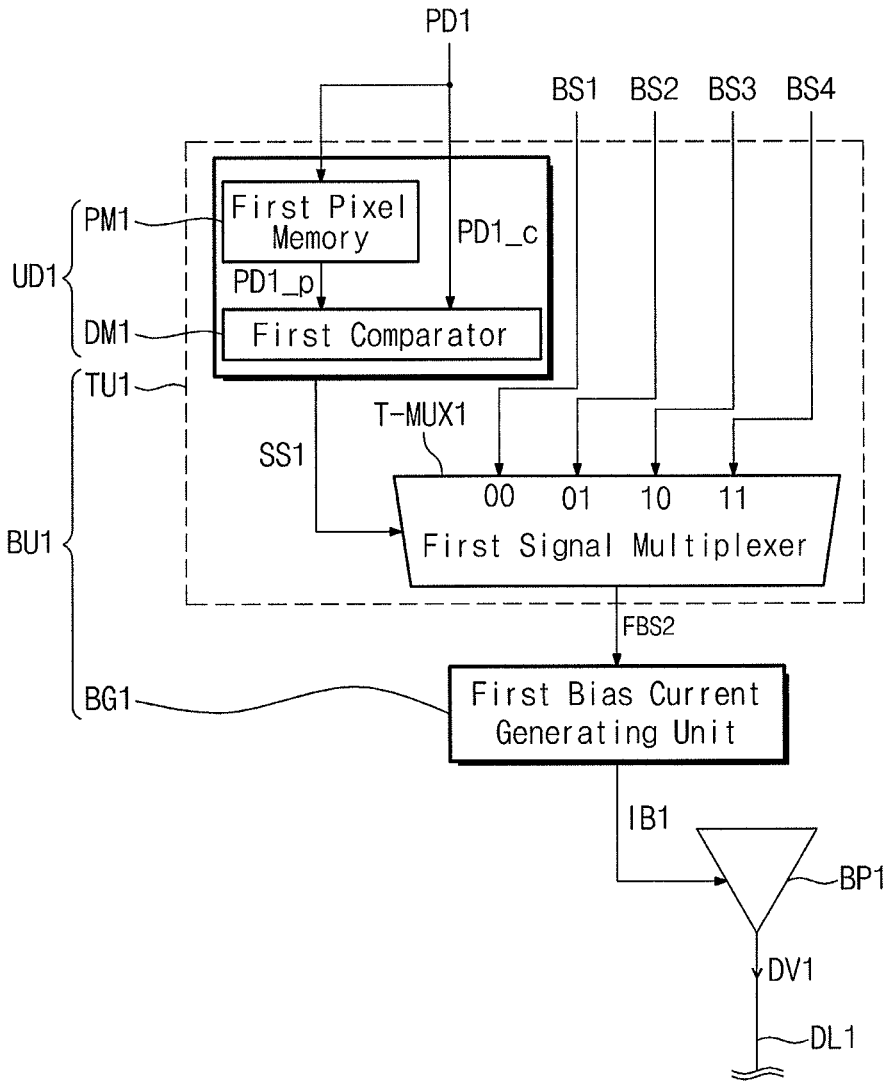
FIG. 14 illustrates another embodiment of a first bias unit.

FIG. 13 illustrates another embodiment of a bias signal generating unit, and FIG. 14 illustrates another embodiment of a first bias unit. Referring to FIG. 13, the bias signal generating unit 350 generates a plurality of bias signals. The bias signals may include first to fourth bias signals BS1 to BS4, which are different from each other. The first to fourth bias signals BS1 to BS4 may have waveforms substantially similar to the first and second bias signals BS1 and BS2 in FIGS. 4A and 4B.

For example, the first bias signal BS1 has a first transition level during a first transition period and a first control level during a first control period. The second bias signal BS2 has a second transition level during a second transition period and a second control level during a second control period. The third bias signal BS3 has a third transition level during a third transition period and a third control level during a third control period. The fourth bias signal BS4 has a fourth transition level during a fourth transition period and a fourth control level during a fourth control period.

Among the first to fourth control periods, at least one control period may be different from the other control periods. In addition, among the first to fourth transition levels, at least one transition level may be different from the other transition levels. Also, at least one control level of the first to fourth control levels may be different from the other control levels. Various combinations of periods and levels of the first to fourth bias signals BS1 to BS4 may be different from each other in other embodiments. Thus, the first to fourth bias signals BS1 to BS4 may have different waveforms.

The bias signal generating unit 350 includes the memory 351, the control level value generator 352, the counter 353, and a bias signal generator 554.

The memory 351 stores first to fourth transition level values TV1 to TV4, including information about the first to fourth transition levels. In addition, the memory 351 stores first to fourth bias different values BD1 to BD4 respectively including information about differences between the first to fourth transition levels and the first to fourth control levels, first to fourth control start time points CS1 to CS4 including information about the start point of the first to fourth control periods, and first to fourth control end time points CT1 to CT4 including information about the first to fourth control periods.

The control level value generator 352 receives the first to fourth transition level values TV1 to TV4 and the first to fourth bias different values BD1 to BD4 from the memory 351. The control level value generator 352 subtracts the first to fourth bias different values BD1 to BD4 from the first to fourth transition level values TV1 to TV4, respectively, and generates first to fourth control level values LS1 to LS4, respectively, to determine the first to fourth control levels.

The counter 353 receives the clock signal CLK and generates first to fourth activation signals ES1 to ES4 based on the first to fourth control start time points CS1 to CS4 and the first to fourth control end time points CT1 to CT4, to respectively determine the first to fourth control periods. Operation of the counter 353 may be as described with reference to FIG. 3.

The bias signal generator 554 includes first to fourth sub-bias signal generators 554*a* to 554*d* that respectively generate the first to fourth bias signals BS1 to BS4.

The first sub-bias signal generator 554*a* receives the first transition level value TV1, the first control level value LS1, and the first activation signal ES1 and generates the first bias signal BS1 based on the first transition level value TV1, the first control level value LS1, and the first activation signal ES1.

The second sub-bias signal generator 554*b* receives the second transition level value TV2, the second control level value LS2, and the second activation signal ES2 and generates the second bias signal BS2 based on the second transition level value TV2, the second control level value LS2, and the second activation signal ES2.

The third sub-bias signal generator 554*c* receives the third transition level value TV3, the third control level value LS3, and the third activation signal ES3 and generates the third bias signal BS3 based on the third transition level value TV3, the third control level value LS3, and the third activation signal ES3.

The fourth sub-bias signal generator 554*d* receives the fourth transition level value TV4, the fourth control level value LS4, and the fourth activation signal ES4 and generates the fourth bias signal BS4 based on the fourth transition level value TV4, the fourth control level value LS4, and the fourth activation signal ES4.

Operation of the first to fourth sub-bias signal generators 554*a* to 554*d* may be substantially the same as the first and second bias signal generators 354*a* and 354*b* in FIGS. 5 and 6.

Referring to FIG. 14, the first bias unit BU1 includes the first selecting unit TU1 and the first bias current generating unit BG1. In addition, the first selecting unit TU1 includes a first variation detector UD1 and a first signal multiplexer T-MUX1. The first variation detector UD1 receives the first pixel image data PD1 and generates the first selection signal SS1 in accordance with the first pixel image data PD1. The first variation detector UD1 includes the first pixel memory PM1 and a first comparator DM1.

The first comparator DM1 compares the previous first pixel image data PD1_*p* and the present first pixel image data PD1_*c* and generates the first selection signal SS1. As an example, the first comparator DM1 calculates an absolute value of a difference between a previous grayscale value of the previous first pixel image data PD1_*p* and a present grayscale value of the present first pixel image data PD1_*c*, and generates the first selection signal SS1 based on the absolute value of the difference between the previous grayscale value of the previous first pixel image data PD1_*p* and the present grayscale value of the present first pixel image data PD1_*c*.

In the present exemplary embodiment, the first comparator DM1 compares upper 2 bits of the present first pixel image data PD1_*c* and upper 2 bits of the previous first pixel image data PD1_*p* to generate the first selection signal SS1. Accordingly, the first selection signal SS1 may have four values of "00", "01", "10", and "11".

The first signal multiplexer T-MUX1 receives the first to fourth bias signals BS1 to BS4 from the bias signal generating unit 350, and receives the first selection signal SS1 from the first comparator DM1. The first signal multiplexer T-MUX1 selects one bias signal of the first to fourth bias signals BS1 to BS4 based on the first selection signal SS1 and outputs the selected bias signal as the first final bias signal FBS1.

For instance, when the first selection signal SS1 has the value of "00", the first signal multiplexer T-MUX1 selects the first bias signal BS1. When the first selection signal SS1 has the value of "01", the first signal multiplexer T-MUX1 selects the second bias signal BS2. In addition, when the first selection signal SS1 has the value of "10", the first signal multiplexer T-MUX1 selects the third bias signal BS3. When the first selection signal SS1 has the value of "11", the first signal multiplexer T-MUX1 selects the fourth bias signal BS4.

The first bias current generating unit BG1 receives the first final bias signal FBS1 from the first signal multiplexer T-MUX1 and generates the first bias current IB1 based on the first final bias signal FBS1. The first bias current generating unit BG1 applies the first bias current IB1 to the first buffer BP1.

In the present exemplary embodiment described with reference to FIGS. 13 and 14, the bias signal generating unit 350 generates the four bias signals and the first selecting unit TU1 selects one of the four bias signals based on the compared results of the upper 2 bits of the first pixel image data PD1.

In this or another embodiment, the bias signal generating unit 350 may generate 2i ("i" is a natural number) bias signals and the first selecting unit TU1 may select one of the 2i ("i" is a natural number) bias signals based on the compared results of upper i bits of the first pixel image data PD1.

As the number of the bias signals selected by the first selecting unit TU1 increases, the first selecting unit TU1 selects the bias signal more precisely corresponding to variation in the amount of the first data voltage DV1. Therefore, the first buffer BP1 receives the first bias current IB1 corresponding to the variation in amount of the first data voltage DV1, and has a through rate corresponding to variation in the amount of the first data voltage DV1. As a result, power consumption in the first buffer BP1 may be reduced.

Figure 15:
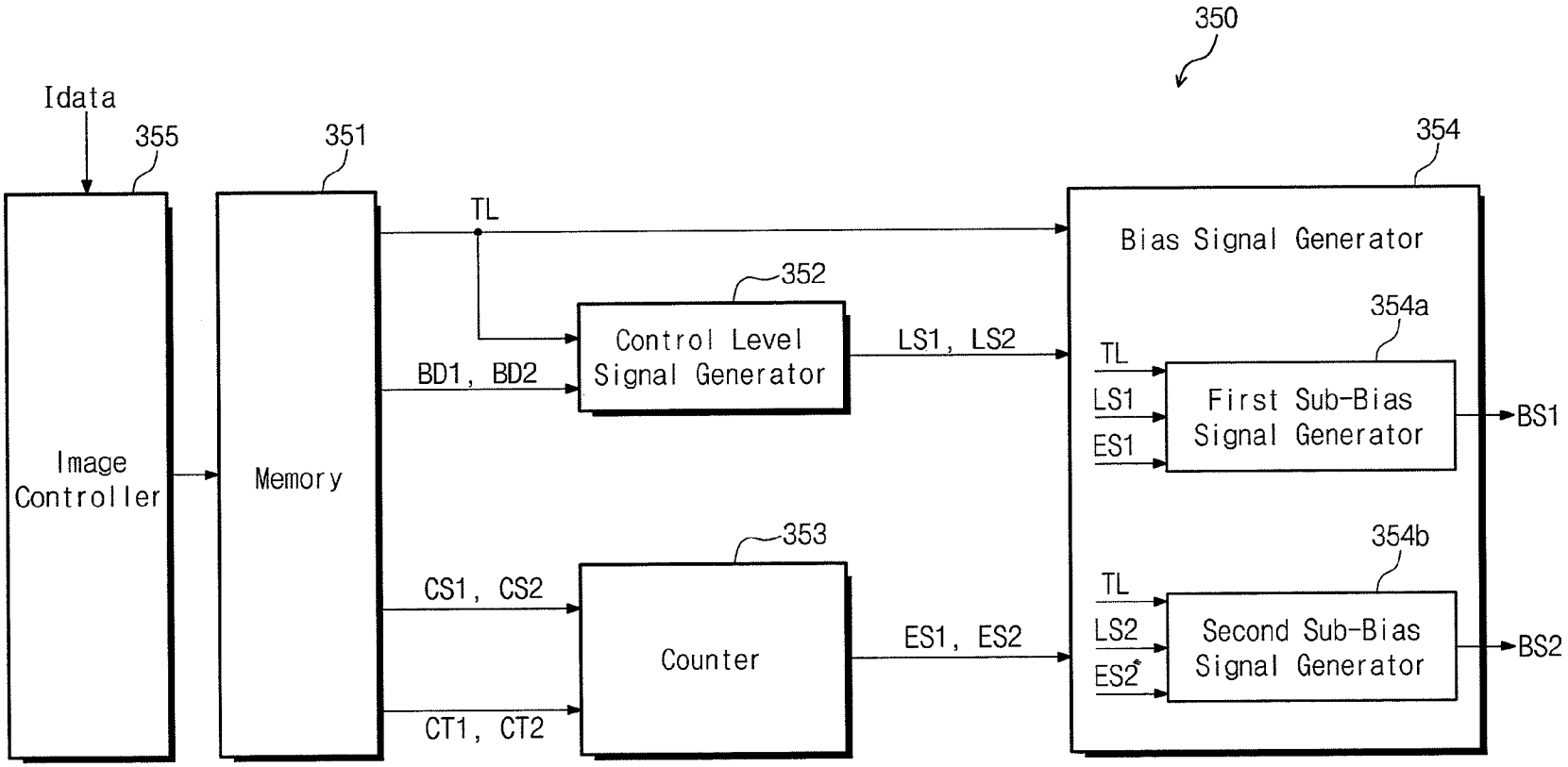
FIG. 15 illustrates another embodiment of a bias signal generating unit.

FIG. 15 illustrates another embodiment of a bias signal generating unit 350 which includes an image controller 355. The image controller 355 receives the input image data Idata, analyzes the input image data Idata, generates at least one of the transition level TL, the first and second bias different values BD1 and BD2, the first and second control start time points CS1 and CS2, or the first and second control end time points CT1 and CT2 based on the analyzed result, and applies the generated value to the memory 351.

For example, the image controller 355 analyzes the input image data Idata, and calculates an average grayscale value of the input image data Idata, and generates at least one of the transition level TL, the first and second bias different values BD1 and BD2, the first and second control start time points CS1 and CS2, or the first and second control end time points CT1 and CT2 based on the average grayscale value.

In the present exemplary embodiment, the image controller 355 periodically analyzes the input image data every horizontal period and newly generates at least one of the transition level TL, the first and second bias different values BD1 and BD2, the first and second control start time points CS1 and CS2, or the first and second control end time points CT1 and CT2.

As described above, when the bias signal generating unit 350 includes the image controller 355, the waveforms of the first and second bias signals BS1 and BS2 are determined depending on the input image data Idata. Accordingly, the first to n-th bias currents IB1 to IBn having waveforms corresponding to the input image data Idata may be generated based on the first and second bias signals BS1 and BS2.

In the present exemplary embodiment, the image controller 355 serves as a part of the data driver 300. In another embodiment, the image controller 355 may be included in the timing controller 400. In addition, the image controller 355 may be provided in a card or board shape without being included in the timing controller 400. In this case, the image controller 355 may be connected between the image source and the timing controller 400, or may be in a device connected between the image source and the timing controller 400.

By way of summation and review, one type of data driver drives pixels in a display based on an analog driving voltage. More specifically, this data driver generates a data voltage using the analog driving voltage and outputs the data voltage to the data lines through buffers. Power consumption by the buffers consume a large portion of the total power consumed by the data driver.

In accordance with one or more of the aforementioned embodiments, a data driver includes a plurality of buffers to respectively output data voltages corresponding to pixel image data, a plurality of bias units BU1 to BUn which are provided in one-to-one correspondence to the buffers and which generate bias currents IB1 to IBn independent to each other and apply the bias currents to the buffers, respectively, and a bias signal generating unit to generate a plurality of bias signals. Each of the bias units includes a selecting unit to select one bias signal among the bias signals based on a corresponding pixel image data among the pixel image data and top output the selected bias signal as a final bias signal; and a bias current generating unit to generate a corresponding bias current among the bias currents in response to the final bias signal. The bias currents may be controlled according to variation in the amount of the data voltage output from the buffers in each horizontal period in the unit of buffer. As a result, the power consumption in the buffers may be reduced.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A data driver, comprising:

a plurality of buffers to respectively output data voltages corresponding to pixel image data;

a plurality of bias circuits provided in one-to-one correspondence with the buffers, the bias circuits to generate bias currents independent of each other and to apply the bias currents to the buffers, respectively; and a bias signal generator to generate a plurality of bias signals, wherein each of the bias circuits include:

a selector to select one bias signal among the bias signals based on corresponding pixel image data among the pixel image data and to output the selected bias signal as a final bias signal; and a bias current generator to generate a corresponding bias current among the bias currents based on the final bias signal, wherein the selector includes a variation detector and a signal multiplexer, and wherein the variation detector is to receive the corresponding pixel image data among the pixel image data and to generate a selection signal based on the corresponding pixel image data, and wherein the signal multiplexer is to select one of the bias signals based on the selection signal.

2. The data driver as claimed in claim 1, further comprising:

a sampling latch to receive input image data and to sample the pixel image data from the input image data based on a sampling signal; and a digital-to-analog converter to convert the pixel image data to the data voltages and to apply the data voltages to the buffers in one-to-one correspondence, wherein the selector is to receive the corresponding pixel image data from the sampling latch among the pixel image data.

3. The data driver as claimed in claim 1, wherein:

the corresponding pixel image data among the pixel image data includes a previous pixel image data provided in an (L−1)th horizontal period and a present pixel image data provided in an L-th horizontal period, and the variation detector includes:

a pixel memory to store the previous pixel image data; and a comparator to calculate an absolute value of a difference between a previous grayscale value of the previous pixel image data and a present grayscale value of the present pixel image data, and to generate the selection signal based on the calculated absolute value.

4. The data driver as claimed in claim 3, wherein the comparator is to compare upper i ("i" is a natural number) bits of the previous pixel image data and upper i bits of the present pixel image data to generate the selection signal, and wherein a number of the bias signals is 2×i.

5. The data driver as claimed in claim 4, wherein i is 1 and the comparator is to receive the previous pixel image data and the present pixel image data and is to perform an exclusive-OR calculation on the previous pixel image data and the present pixel image data.

6. The data driver as claimed in claim 1, wherein the bias signals include:

a first bias signal, and a second bias signal different from the first bias signal, wherein the first bias signal includes a first transition period and a first control period which are defined in each horizontal period, wherein the second bias signal includes a second transition period and a second control period which are defined in each horizontal period, wherein the first bias signal has a first transition level in the first transition period and has a first control level lower than the first transition level in the first control period, and wherein the second bias signal has a second transition level in the second transition period and has a second control level lower than the second transition level in the second control period.

7. The data driver as claimed in claim 6, wherein the first control level is different from the second control level.

8. The data driver as claimed in claim 6, wherein the first transition level is different from the second transition level.

9. The data driver as claimed in claim 6, wherein at least a portion of the first control period does not overlap the second control period.

10. The data driver as claimed in claim 6, wherein the bias signal generator includes:

a bias signal generator including first and second sub-bias signal generators to respectively generate the first and second bias signals, wherein:

the first sub-bias signal generator is to generate the first bias signal based on a first transition level value determining the first transition level, a first control level value determining the first control level, and a first activation signal determining the first control period, and the second sub-bias signal generator is to generate the second bias signal based on a second transition level value determining the second transition level, a second control level value determining the second control level, and a second activation signal determining the second control period.

11. The data driver as claimed in claim 10, wherein:

the first sub-bias signal generator includes:

a first level value multiplexer to select one value of the first transition level value or the first control level value based on the first activation signal, and to output the selected value as a first intermediate bias signal; and a first bias signal generating circuit to generate the first bias signal based on the first intermediate bias signal and a reference bias current, the second sub-bias signal generator includes:

a second level value multiplexer to select one value of the second transition level value or the second control level value based on the second activation signal, and to output the selected value as a second intermediate bias signal; and a second bias signal generating circuit to generate the second bias signal based on the second intermediate bias signal and the reference bias current.

12. The data driver as claimed in claim 10, wherein:

the bias signal generator is to subtract a first bias difference value from the first transition level value to generate the first control level value, and is to subtract a second bias difference value from the first transition level value to generate the second control level value, the first bias difference value includes information indicative of a difference between the first transition level and the first control level, and the second bias difference value includes information indicative of a difference between the second transition level and the second control level.

13. The data driver as claimed in claim 12, wherein the bias signal generator includes:

a counter to generate the first control activation signal based on a first control start time point corresponding to a start point of the first control period and a first control end time point corresponding to an end point of the first control period, and is to generate the second control activation signal based on a second control start time point corresponding to a start point of the second control period and a second control end time point corresponding to an end point of the second control period.

14. The data driver as claimed in claim 13, wherein the bias signal generator includes:

an image controller to receive the input image data, analyze the input image data, and generate at least one of the transition level value, the first and second bias difference values, the first and second control start time points, and the first and second control end time points based on the analyzed result.

15. The data driver as claimed in claim 14, wherein the image controller is to analyze the input image data every horizontal period.

16. A method of driving a data driver, comprising:

generating a plurality of data voltages based on pixel image data;

outputting the data voltages through a plurality of buffers, respectively;

generating bias currents;

applying the bias currents to the buffers, respectively; and generating a plurality of bias signals, wherein applying the bias currents to the buffers includes selecting one of the bias signals with respect to each of the buffers based on the pixel image data and generating the bias currents in accordance with the selected bias signal, wherein:

each of the pixel image data includes a previous pixel image data provided in an (L−1)th horizontal period and a present pixel image data provided in an L-th horizontal period, and selecting one of the bias signals includes:

calculating an absolute value of a difference between a previous grayscale value of the previous pixel image data and a present grayscale value of the present pixel image data; and selecting one of the bias signals in accordance with the calculated absolute value.

17. The method as claimed in claim 16, wherein calculating the absolute value of the difference between the previous grayscale value of the previous pixel image data and the present grayscale value of the present pixel image data includes comparing upper i (i is a natural number) bits of the previous pixel image data and upper i bits of the present pixel image data.

18. The method as claimed in claim 17, wherein i is 1 and comparing the upper bits includes:

receiving the previous pixel image data and the present pixel image data; and performing an exclusive-OR calculation on previous pixel image data and the present pixel image data.

* * * * *